US008665201B2

(12) United States Patent
Ueno

(10) Patent No.: US 8,665,201 B2
(45) Date of Patent: Mar. 4, 2014

(54) DISPLAY DEVICE AND METHOD FOR DRIVING DISPLAY DEVICE

(75) Inventor: Koji Ueno, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 437 days.

(21) Appl. No.: 12/737,938

(22) PCT Filed: Oct. 6, 2009

(86) PCT No.: PCT/JP2009/067392

§ 371 (c)(1),
(2), (4) Date: Mar. 2, 2011

(87) PCT Pub. No.: WO2010/041649

PCT Pub. Date: Apr. 15, 2010

(65) Prior Publication Data

US 2011/0148825 A1 Jun. 23, 2011

(30) Foreign Application Priority Data

Oct. 10, 2008 (JP) ..... 2008-264362

(51) Int. Cl.
*G09G 3/36* (2006.01)

(52) U.S. Cl.
USPC ..... 345/100; 345/98; 345/204

(58) Field of Classification Search
USPC ..... 345/87–104, 204–213, 690–699
See application file for complete search history.

(56) References Cited

U.S. PATENT DOCUMENTS 5,815,129 A * 9/1998 Jung ..... 345/93
5,923,512 A 7/1999 Brownlow et al.
6,191,770 B1 * 2/2001 Kim ..... 345/100
6,362,643 B1 * 3/2002 Kim ..... 324/760.02
6,483,493 B2 * 11/2002 Murade ..... 345/87
6,747,503 B2 * 6/2004 Fotouhi ..... 327/365
6,970,274 B2 * 11/2005 Morita et al. ..... 358/474
7,486,269 B2 * 2/2009 Moon ..... 345/100
8,284,377 B2 * 10/2012 Hsu et al. ..... 349/192
2002/0075248 A1 * 6/2002 Morita et al. ..... 345/204
2003/0173991 A1 9/2003 Takafuji et al.
2005/0206606 A1 9/2005 Takafuji et al.
2005/0285830 A1 * 12/2005 Iwabuchi ..... 345/77

(Continued)

FOREIGN PATENT DOCUMENTS

CN 101154342 4/2008
JP 62010696 A 1/1987

(Continued)

OTHER PUBLICATIONS

International Search Report.

*Primary Examiner* — Dmitriy Bolotin

(74) *Attorney, Agent, or Firm* — Harness, Dickey & Pierce, P.L.C.

(57) ABSTRACT

A display device includes: a source driver; a plurality of gate drivers which share a plurality of scan signal lines to which they are connected; a gate output judging section for judging whether or not each of the plurality of gate drivers has a failure, on the basis of timing at which a gate signal Gout is outputted from a corresponding one of the plurality of gate drivers; and a control section for, in a case where the gate output judging section judges that the gate driver has a failure, switching over to the gate driver. This makes it possible to extend a lifetime of the display device with not a complicated arrangement but a simple arrangement.

14 Claims, 22 Drawing Sheets

(56) References Cited

U.S. PATENT DOCUMENTS

| | | | | |
|---|---|---|---|---|
| 2006/0007218 | A1* | 1/2006 | Miyake et al. | 345/204 |
| 2006/0050027 | A1 | 3/2006 | Meguro et al. | |
| 2006/0164118 | A1* | 7/2006 | Taguchi | 324/770 |
| 2006/0203604 | A1* | 9/2006 | Park et al. | 365/233 |
| 2006/0267913 | A1* | 11/2006 | Mochizuki et al. | 345/100 |
| 2007/0046615 | A1* | 3/2007 | Tsuida et al. | 345/100 |
| 2007/0164972 | A1* | 7/2007 | Chang | 345/100 |
| 2008/0012842 | A1* | 1/2008 | Mori | 345/206 |
| 2008/0079001 | A1 | 4/2008 | Umezaki et al. | |
| 2008/0165110 | A1* | 7/2008 | Kim et al. | 345/99 |
| 2008/0266275 | A1* | 10/2008 | Tsai et al. | 345/204 |
| 2010/0201902 | A1* | 8/2010 | Hsu et al. | 349/54 |
| 2011/0148825 | A1* | 6/2011 | Ueno | 345/204 |

FOREIGN PATENT DOCUMENTS

| | | | |
|---|---|---|---|
| JP | 3296714 | A | 12/1991 |
| JP | 06067200 | A | 3/1994 |
| JP | 8050796 | A | 2/1996 |
| JP | 10339861 | A | 12/1998 |
| JP | 2003216126 | A | 7/2003 |
| JP | 2003271109 | A | 9/2003 |
| JP | 2006099050 | A | 4/2006 |
| JP | 2009008891 | A | 1/2009 |

* cited by examiner

DISPLAY DEVICE AND METHOD FOR DRIVING DISPLAY DEVICE

TECHNICAL FIELD

The present invention relates to: a display device including a display panel, such as an active matrix liquid crystal display panel, which includes a plurality of scan signal lines, a plurality of data signal lines, a plurality of pixel electrodes, and a plurality of switching elements each of which is (i) connected to a corresponding one of the plurality of scan signal lines, a corresponding one of the plurality of data signal lines, and a corresponding one of the plurality of pixel electrodes, and (ii) turned on/off by the corresponding one of the plurality of scan signal lines; and a method for driving the display device.

BACKGROUND ART

In recent years, there has been proposed a monolithic circuit for an active matrix liquid crystal display device, in which a scan signal line driving circuit and a data signal line driving circuit are integrally provided on a single TFT substrate. Such a monolithic circuit can contribute to miniaturization of a body of the display device and simplification of a production process of the display device. However, in contrast, such a monolithic circuit has been one of factors causing a reduction in yield rates. This is because an entire display panel would be determined as a defective product in a case where a driving circuit has a failure.

Patent Literature 1 etc. have disclosed a technique for preventing, with a simple arrangement, a reduction in yield rates due to such a failure in the driving circuit. FIG. 20 is a view illustrating a schematic arrangement of a liquid crystal display device of Patent Literature 1. The liquid crystal display device includes two systematic scan signal line driving circuits 13 and 15 and two systematic data signal line driving circuits 17 and 19. Therefore, (i) in a case where one of the two scan signal line driving circuits 13 and 15 has a failure, the liquid crystal display device can switch over the one having a failure to the other one having no failure (i.e. a normal one, which is hereinafter referred to as "redundant circuit" in some cases) and (ii) in a case where one of the two data signal line driving circuits 17 and 19 has a failure, the liquid crystal display device can switch over the one having a failure to the other one having no failure (redundant circuit). This arrangement is simple but capable of increasing yield rates by reducing a percentage of defective display panels.

CITATION LIST

Patent Literature 1

Japanese Patent Application Publication, Tokukaihei, No. 06-67200 A (Publication Date: Mar. 11, 1994)

SUMMARY OF INVENTION

Technical Problem

The technique disclosed in Patent Literature 1, however, has the following problem. Inspection of each driving circuit for a failure and the subsequent switchover to the redundant circuit (if necessary) are carried out before the liquid crystal display device is shipped as a product, more specifically, in a final inspection process of a production process. This is because the foregoing arrangement aims at an increase in yield rates only. For this reason, once the liquid crystal display device is determined as a normal product and then is shipped, it is difficult to switch over the driving circuit having a failure to the redundant circuit.

In other words, although the liquid crystal display device includes the redundant circuits, (i) the switchover to the redundant circuit is not automatically carried out in response to a failure that occurs in the driving circuit while the liquid crystal display device has been used by a user over a long duration, and (ii) such a failure in the driving circuit therefore causes the display panel to be regarded as a defective display panel.

Meanwhile, there is also a case where a display panel including a normal LSI has a failure in long-term use, although the failure in the display panel hardly occurs as compared with other display panels. In some cases, the display panel is used in a situation where (i) the display panel is required to have high reliability, and (ii) even such a small risk of a failure cannot be accepted. The recent monolithic circuit in which the driving circuits are integrally provided in the display panel has a higher risk of a failure. Particularly, a monolithic circuit in which the driving circuits are integrally provided in an amorphous panel has a significantly high risk of a failure.

The following description specifically deals with how a failure occurs in such a monolithic circuit with reference to FIGS. 3, 21, and 22. FIG. 3 is a block diagram illustrating an arrangement of an entire display panel, where a gate driver is integrally provided in the display panel (i.e. one example of an arrangement of the gate driver). Further, FIG. 21 is a circuit diagram illustrating an internal arrangement of each of a plurality of shift registers which constitute the gate driver illustrated in FIG. 3. Here, each of the plurality of shift registers employs TFTs all of which are of the N channel-type, and is integrally provided in the display panel by use of amorphous silicon or another material. FIG. 22 is a timing chart showing how the shift register illustrated in FIG. 21 is operated, as an example.

A terminal Qn−1 of an uppermost shift register illustrated in FIG. 3 receives a GSPOI from a controller section. Each of the other shift registers receives an output via its terminal Qn−1 from a preceding shift register (set). Each of the plurality of shift registers supplies an output to a terminal Qn+1 of the preceding shift register (reset). Each of odd-numbered shift registers receives a GCK via its terminal cka and a GCKB via its terminal ckb, while each of even-numbered shift registers receives the GCKB via its terminal cka and the GCK via its terminal ckb. The following explains an operation principle of the odd-numbered (2n+1)th shift register, as an example. The (2n+1)th shift register receives a Gout from the preceding (2n)th shift register ("Gn−1 (PRECEDING STAGE)" shown in FIG. 21). This turns on a transistor TrB, so that a net A of the (2n+1)th shift register is turned to be at a Hi level. When the GCK (connected to "cka" shown in FIG. 21) rises, the net A is further boosted due to a bootstrap effect of a TrI section. This turns on the TrI. When the TrI is turned on, the GCK is outputted as the Gout of the (2n+1)th shift register without any change. Similarly, the Gout of the (2n+1)th shift register sets the subsequent (2n+2)th shift register, so that a Gout of the (2n+2)th shift register is outputted at timing of a next rise of the GCKB. The Gout of the (2n+2)th shift register is supplied to "Gn+1 (SUBSEQUENT STAGE)" shown in FIG. 21. Therefore, the Gout of the (2n+2)th shift register turns on the TrL and TrN of the (2n+1)th shift register, and the Gout and net A of the (2n+1)th shift register are turned to be at a Lo level. Such a cycle is repeated so that the output of the Gout is shifted from the first shift register to the last shift register. Note that a CLR signal is used to forcibly stop supplying the output or reset the plurality of shift registers.

As is conventionally known, such a circuit is likely to positively shift a threshold voltage (Vth) of a transistor due to a long-term operation. This reduces current drivability of the transistor. The reduction results in a problem that the shift operation cannot be carried out properly. This problem also depends on a temperature. The harsher environment the liquid crystal display device is used in, the more frequently the problem occurs.

As such, the conventional driving circuit has a risk of a failure in long-term use. Therefore, it is significantly difficult to apply the conventional liquid crystal display device employing such a driving circuit to a field of, for example, an in-car instrument panel, in which the liquid crystal display device is required to have high reliability (high temperature range) and a long life in particular.

The present invention is made in view of the problems. An object of the present invention is to provide: a display device which can have a longer lifetime with an arrangement which is not complicated but simple; and a method for driving the display device.

Solution to Problem

In order to attain the object, a display device of the present invention includes: a display panel including a plurality of scan signal lines, a plurality of data signal lines, a plurality of pixel electrodes, and a plurality of transistors each of which (i) is connected to a corresponding one of the plurality of scan signal lines, a corresponding one of the plurality of data signal lines and a corresponding one of the plurality of pixel electrodes and (ii) is turned on/off by a scan signal supplied via the corresponding one of the plurality of scan signal lines; a plurality of signal line driving circuits including at least one of (1) a plurality of first signal line driving circuits, which share scan signal lines to which they are connected and (2) a plurality of second signal line driving circuits, which share data signal lines to which they are connected; judging means for judging, whether or not at least one of the plurality of signal line driving circuits has a failure, on the basis of timing at which its output signal is outputted from a corresponding one of the plurality of signal line driving circuits; and switching means for switching over to another one of the plurality of signal line driving circuits, having no failure, in a case where the judging means judges that at least one of the plurality of signal line driving circuits has a failure.

According to the arrangement, it is judged whether or not the scan signal line driving circuit has a failure, on the basis of timing at which its output signal is outputted from the scan signal line driving circuit, and the scan signal driving circuit is switched over to another normal scan signal line driving circuit in a case where it is judged that the scan signal line driving circuit has a failure. In a similar manner, it is judged whether or not the data signal line driving circuit has a failure, on the basis of timing at which its output signal is outputted from the data signal line driving circuit, and the data signal line driving circuit is switched over to another normal data signal line driving circuit in a case where it is judged that the data signal line driving circuit has a failure.

As described above, the display device of the present invention judges whether or not each of the plurality of signal line driving circuits has a failure, on the basis of timing at which its output signal is outputted from such a signal line driving circuit. Therefore, it is possible to detect a failure in the display device not only in the final inspection process carried out before the display device is shipped as a product but while the display device is in use. Further, the signal line driving circuit determined as having a failure is switched over to another normal signal line driving circuit by the switching means on the basis of the result of the judging. Therefore, its display function is not suspended abruptly even if any one of the plurality of signal line driving circuits has a failure in long-term use. Accordingly, it is possible to extend the lifetime of the display device with an arrangement which is not complicated but simple, as compared with a conventional arrangement.

Note that the plurality of scan signal line driving circuits may be (i) either the plurality of scan signal line driving circuits or the plurality of data signal line driving circuits, or (ii) both of them.

In the display device of the present invention, the judging means may judge (i) whether or not each output signal is outputted from a corresponding one of the plurality of signal line driving circuits at predetermined timing and (ii) whether or not each output signal is outputted from a corresponding one of the plurality of signal line driving circuits at timing other than the predetermined timing, the judging means determining that a signal line driving circuit has no failure, in a case where it determines that an output signal is outputted from a corresponding one of the signal line driving circuits at the predetermined timing but not at timing other than the predetermined timing, whereas determining that a signal line driving circuit has a failure, in a case where (i) it determines that an output signal is not outputted at the predetermined timing from a corresponding one of the signal line driving circuits, (ii) it determines that the output signal is outputted at timing other than the predetermined timing, or (iii) it determines that the output signal is outputted at the predetermined timing and at timing other than the predetermined timing.

According to the arrangement, it is possible to detect various failures, such as (i) a case where no output signal is outputted from the signal line driving circuit, or (ii) a case where the output signal is outputted both at predetermined timing and at timing other than the predetermined timing. Therefore, it is possible to increase detection accuracy for a failure in the signal line driving circuit.

In the display device of the present invention, the predetermined timing may be timing when 1 vertical scanning time period expires, and the judging means may judge (i) whether or not each of the output signals is outputted from a corresponding one of the plurality of signal line driving circuits at the timing when 1 vertical scanning time period expires and (ii) whether or not each of the output signals is outputted from a corresponding one of the signal line driving circuits at timing other than the timing when 1 vertical scanning time period expires.

This makes it possible to easily judge whether or not the output signal is outputted from the signal line driving circuit at the predetermined timing.

In the display device of the present invention, the predetermined timing may be timing when 1 horizontal scanning time period expires, and the judging means may judge (i) whether or not each of the output signals is outputted from a corresponding one of the plurality of signal line driving circuit at the timing when 1 horizontal scanning time period expires and (ii) whether or not each of the output signals is outputted from a corresponding one of the plurality of signal line driving circuits at timing other than the timing when 1 horizontal scanning time period expires.

This makes it possible to judge, per horizontal scanning period, whether or not the output signal is outputted from the signal line driving circuit at timing other than the predetermined timing. Therefore, it is possible to increase the detection accuracy for a failure of the output signal.

In the display device of the present invention, the plurality of first signal line driving circuits may be scan signal line driving circuits, a dummy scan signal line, which does not contribute to display, may be provided most downstream in a scanning direction, and the judging means may judge (i) whether or not a scan signal is supplied to the dummy scan signal line at timing when 1 horizontal scanning time period of an endmost one of the plurality of scan signal lines in the scanning direction expires and (ii) whether or not the scan signal is supplied to the dummy scan signal line at timing other than the timing when the 1 horizontal scanning period of the endmost one of the plurality of scan signal lines expires.

In a case where the scan signal outputted to the scan signal line which contributes to display is then supplied to the judging means, there is a risk that load capability of the scan signal line may become greater and this may cause a reduction in display quality, for example. In view of the problem, the judging means of the foregoing arrangement uses the scan signal outputted to the dummy scan signal line which does not contribute to display. Therefore, it is possible to prevent a reduction in display quality without an increase in load capability of the scan signal line.

In the display device of the present invention, the plurality of first signal line driving circuits may be scan signal line driving circuits each of which is connected to the plurality of scan signal lines via a respective plurality of switching elements, and the switching means may switch over a scan signal line driving circuit which is determined to have a failure by the judging means to the other of the plurality of scan signal line driving circuits, having no failure, by (i) supplying an OFF signal to switching elements connected to the scan signal line driving circuit which is determined to have a failure and (ii) supplying an ON signal to switching elements connected to the other of the plurality of scan signal line driving circuits, having no failure.

According to the arrangement, it is possible to electrically disconnect the scan signal line having a failure from the plurality of scan signal lines. Therefore, it is possible to suppress the risk that the scan signal line driving circuit having a failure falsely operates after the scan signal line driving circuit having the failure is switched over to another scan signal line driving circuit having no failure.

In the display device of the present invention, the switching means may further (i) stop supplying a gate start pulse to the scan signal line driving circuit which is determined to have a failure and (ii) supply the gate start pulse to the other of the plurality of scan signal line driving circuits, having no failure.

According to the arrangement, the gate pulse is not supplied to the scan signal line driving circuit having a failure so as to stop operating the scan signal line driving circuit having a failure. Therefore, it is possible to reduce a waste of power consumption. Additionally, in a case of the monolithic circuit, it is possible to prevent the threshold value from shifting. Therefore, it is also possible to extend a total lifetime of the display device.

In the display device of the present invention, the plurality of second signal line driving circuits may be data signal line driving circuits, and the judging means may judge whether or not a data signal line driving circuit has a failure, on the basis of timing at which a data signal is outputted from the data signal line driving circuit.

This makes it possible to easily judge whether or not the data signal line driving circuit has a failure. Note that the data signal is, specifically, a signal applied to each of the plurality of data signal lines from the data signal line driving circuit, or a signal corresponding to a source start pulse supplied from the data signal line driving circuit to the control circuit (control section).

In the display device of the present invention, the judging means may (i) stop supplying a source start pulse to the data signal line driving circuit which is determined to have a failure and (ii) start supplying the source start pulse to the other of the plurality of data signal line driving circuits, having no failure.

According to the arrangement, the source start pulse is not supplied to the data signal line driving circuit having a failure, so as to stop operating the data signal line driving circuit having the failure. Therefore, it is possible to reduce a waste of power consumption.

The display device of the present invention may further include counting means for counting number of times by which the judging means determines that timing, at which an output signal is outputted from a signal line driving circuit, is not normal, the judging means determining that a signal line driving circuit has a failure in a case where counting of counted by the counting means for the signal line driving circuit reaches a predetermined number of times.

According to the arrangement, it is possible to set, to be 2 or more, the number of times by which the output signal is judged as being not normal. This makes it possible to prevent the signal line driving circuit from falsely switched over to another signal line driving circuit in a case where, for example, a failure (such as noise) which does not have an influence on display is detected only once. Therefore, it is possible to increase the reliability of the display device.

The display device of the present invention may further include informing means for informing outside how the plurality of signal line driving circuits operate, the informing means informing outside, in accordance with a result judged by the judging means, whether or not each of the plurality of signal line driving circuits has a failure.

This allows a user to recognize a failure in any one of the plurality of signal line driving circuits. Specifically, the user can recognize such a failure by a conventional method, such as a lighted LED lamp, a displayed message, or an error sound.

Here, it would be a big problem for a driver if (i) the display device is applied to, for example, an in-car instrument panel and (ii) the display panel of the display device does not display speed meter and the like. In view of the problem, the foregoing arrangement allows these to be displayed normally by using a normal signal line driving circuit even if one of the plurality of signal line driving circuit has a failure. Simultaneously, the arrangement allows the driver to recognize that the one of the plurality of signal line driving circuits has a failure. That is, it is possible to allow the user to appropriately take an action for the signal line driving circuit having the failure, such as replacement of components or fixing of the signal line driving circuit, while the instrument panel normally operates. Therefore, it is possible to avoid the worst situation, i.e. a case where the instrument panel does not display anything.

In order to attain the object, a method of the present invention, for driving a display device, the display device including: a display panel including a plurality of scan signal lines, a plurality of data signal lines, a plurality of pixel electrodes, and a plurality of transistors each of which (i) is connected to a corresponding one of the plurality of scan signal lines, a corresponding one of the plurality of data signal lines and a corresponding one of the plurality of pixel electrodes and (ii) is turned on/off by a scan signal supplied via the corresponding one of the plurality of scan signal lines; and a plurality of signal line driving circuits including at least one of (1) a plurality of first signal line driving circuits, which share scan signal lines to which they are connected and (2) a plurality of second signal line driving circuits, which share data signal lines to which they are connected, includes the steps of: judging, whether or not at least one of the plurality of signal line driving circuits has a failure, on the basis of timing at which its output signal is outputted from a corresponding one of the plurality of signal line driving circuits; and switching over to another one of the plurality of signal line driving circuits, having no failure, in a case where the judging means judges that at least one of the plurality of signal line driving circuits has a failure.

According to the arrangement, it is possible to extend the lifetime of the display device with a simple arrangement, as with the display device described above.

Advantageous Effects of Invention

As described above, either a display device or a method for driving the display device (i) judges whether or not at least one of a plurality of signal line driving circuits has a failure, on the basis of timing at which its output signal is outputted from a corresponding one of the plurality of signal line driving circuits, and (ii) in a case where it is judged that the at least one of the plurality of signal line driving circuits has a failure, switches over to another one of the plurality of signal line driving circuits, having no failure.

According to either the arrangement or the method, it is possible to extend a lifetime of a product with an arrangement which is not complicated but simple, as compared with a conventional arrangement.

DESCRIPTION OF EMBODIMENTS

Embodiment 1

One embodiment of the present invention is described below with reference to FIGS. 1 through 7.

Figure 1:
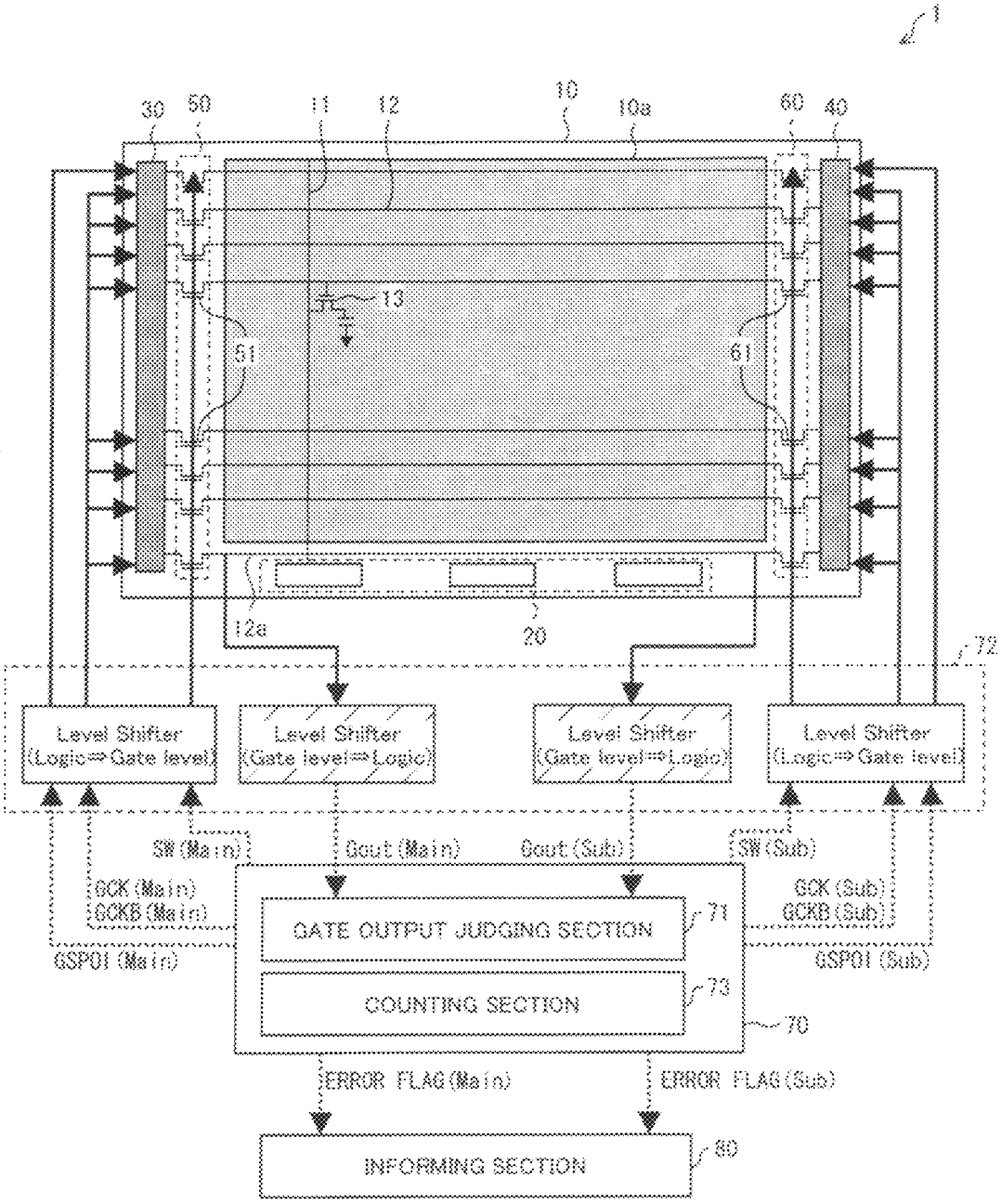
FIG. 1 is a block diagram illustrating an arrangement of a liquid crystal display device in accordance with Embodiment 1 of the present invention.
Figure 2:
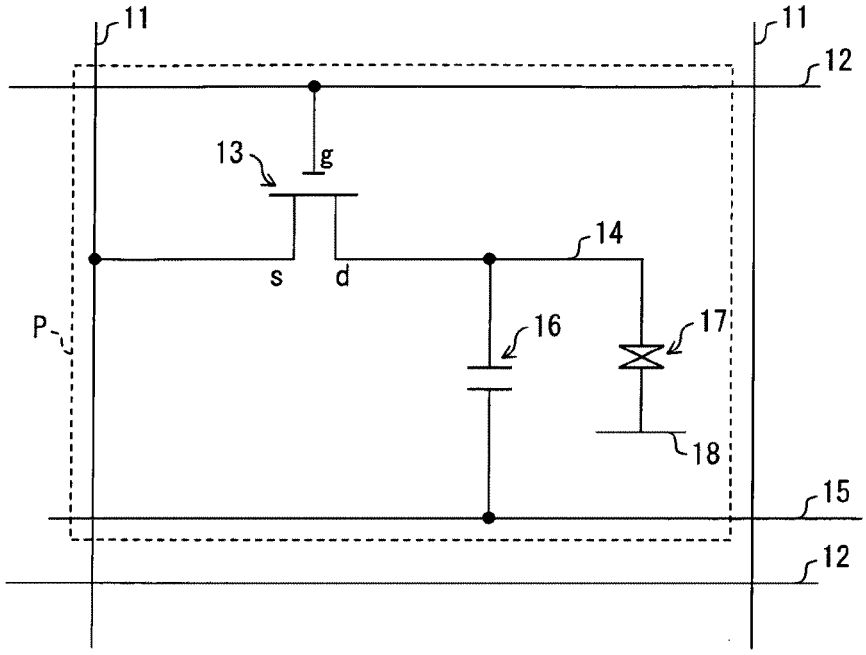
FIG. 2 is an equivalent circuit schematic illustrating an electrical arrangement of each pixel of the liquid crystal display device illustrated in FIG. 1.

The following description deals with an arrangement of a liquid crystal display device 1 (which is a display device of the present invention) with reference to FIGS. 1 and 2. FIG. 1 is a block diagram illustrating an entire arrangement of the liquid crystal display device 1. FIG. 1 illustrates a case in which gate drivers (scan signal line driving circuits) are integrally provided in a display panel. FIG. 2 is an equivalent circuit configuration schematically illustrating an electrical configuration of a single pixel among a plurality of pixels of the liquid crystal display device 1.

The liquid crystal display device 1 includes: an active matrix liquid crystal display panel 10; a source driver (data signal line driving circuit) 20; a first gate driver (scan signal line driving circuit) 30; a second gate driver 40; a first switching section (switching means) 50; a second switching section (switching means) 60; a control section (switching means) 70; and an informing section (informing means) 80.

The liquid crystal display panel 10 is arranged so that (i) liquid crystal is provided between an active matrix substrate (not illustrated) and a counter substrate (not illustrated) and (ii) a plurality of pixels P (see FIG. 2) are arranged in a matrix manner.

According to the liquid crystal display panel 10, (i) a plurality of source bus lines 11; a plurality of gate lines 12; a plurality of thin-film transistors (hereinafter, merely referred to as "TFT") 13; and a plurality of pixel electrodes 14 are provided on the active matrix substrate, and (ii) a counter electrode 18 is provided on the counter substrate (see FIG. 2).

The plurality of source bus lines 11 are provided for respective columns of the plurality of pixels so as to be in parallel with each other in a column direction (vertical direction). The plurality of gate lines 12 are provided for respective rows of the plurality of pixels so as to be in parallel with each other in a row direction (horizontal direction). A dummy gate line (dummy line, dummy scan signal line) 12*a*, which does not contribute to display, is further provided most downstream in a scanning direction so as to be in parallel with the plurality of gate lines 12. The plurality of TFTs 13 and the plurality of pixel electrodes 14 are provided for respective intersections of the plurality of source bus lines 11 and the plurality of gate lines 12. Each of the plurality of TFTs 13 is arranged such that (i) its source electrode "s" is connected to a corresponding one of the plurality of source bus lines 11, (ii) its gate electrode "g" is connected to a corresponding one of the plurality of gate lines 12, and (iii) its drain electrode "d" is connected to a corresponding one of the plurality of pixel electrodes 14. A liquid crystal capacitor 17 is formed by a corresponding one of the plurality of pixel electrodes 14, the counter electrode 18, and the liquid crystal provided between them.

With the arrangement, (i) each TFT 13 is turned on in response to a gate signal (scan signal) supplied via a corresponding one of the plurality of gate lines 12, (ii) a data signal, supplied via a corresponding one of the plurality of source bus lines 11, is written into a corresponding one of the plurality of pixel electrodes 14 so that the corresponding one of the plurality of pixel electrodes 14 is set to have an electric potential corresponding to the data signal (a source signal). This causes a voltage to be applied in accordance with the source signal to the liquid crystal provided between the corresponding one of the plurality of pixel electrodes 14 and the counter electrode 18. It becomes thus possible to carry out a gradation display in accordance with the source signal.

Note that the liquid crystal display device 1 can further include a plurality of CS bus lines (storage capacitor lines) (see FIG. 2). The plurality of CS bus lines (storage capacitor lines) 15 are provided for the respective rows of the plurality of pixels P so as to be in parallel with each other in the row (horizontal) direction, in a similar manner to the plurality of gate lines 12. The plurality of CS bus lines 15 are capacitively-coupled to the respective plurality of pixel electrodes 14. Each storage capacitor (also called "auxiliary capacitor") 16 is defined by a corresponding one of the plurality of pixel electrodes 14 and a corresponding one of the plurality of CS bus lines 15.

In the first switching section 50, a plurality of first switches (switching elements) 51 are provided for the respective plurality of gate lines 12. Specifically, each of the plurality of first switches 51 is arranged such that (i) one of its conductive electrodes is connected to the first gate driver 30 and (ii) the other one of its conductive electrodes is connected to a corresponding one of the plurality of gate lines 12. Further, the plurality of first switches 51 have their control electrodes which are connected to each other. With the arrangement, in a case where an ON signal is supplied via the control electrodes of the respective plurality of first switches 51, all of the plurality of first switches 51 are turned on such that the first gate driver 30 and the plurality of gate lines 12 are electrically connected to each other. In contrast, in a case where an OFF signal is supplied to the control electrodes of the respective plurality of first switches 51, all of the plurality of switches 51 are turned off such that the first gate driver 30 and the plurality of gate lines 12 are electrically disconnected to each other.

In the second switching section 60, a plurality of second switches (switching elements) 61 are provided for the respective plurality of gate lines 12. Specifically, each of the plurality of second switches 61 is such that (i) one of its conductive electrodes is connected to the second gate driver 40, and (ii) the other one of its conductive electrodes is connected to a corresponding one of the plurality of gate lines 12. Further, the plurality of second switches 61 have their control electrodes which are connected to each other. With the arrangement, in a case where an ON signal is supplied to the control electrodes of the respective plurality second switches 61, (i) all of the plurality of second switches 61 are turned on such that the second gate driver 40 and the plurality of gate lines 12 are electrically connected to each other. In contrast, in a case where an OFF signal is supplied to the control electrodes of the respective plurality second switches 61, all of the plurality of switches 61 are turned off such that the second gate driver 40 and the plurality of gate lines 12 are electrically disconnected to each other.

As described above, (i) the first gate driver 30 and the second gate driver 40 have identical functions, (ii) the first gate driver 30 is connected to the plurality of gate lines 12 via the first switching section 50, and (iii) the second gate driver 40 is connected to the plurality of gate lines 12 via the second switching section 60. In other words, the first gate driver 30 and the second gate driver 40 are provided so as to have redundancy. Note that the first gate driver 30 and the second gate driver 40 are, hereinafter, referred to as "main gate driver 30" and "sub gate driver 40 (redundant circuit)", respectively, if necessary.

The control section 70 includes a gate output judging section 71 in addition to a general function (not illustrated) of controlling each of the driving circuits (the gate drivers and the source driver). The gate output judging section 71 monitors a gate signal outputted from each of the first gate driver 30 and the second gate driver 40 so as to judge whether or not the timing at which the gate signal is outputted is normal. In a case where the gate output judging section 71 judges that the gate signal is outputted at improper timing, normal display cannot be expected. Accordingly, it is judged that the gate driver has a failure. How to carry out the judgment will be described later in details.

In addition, the control section 70 outputs a gate driver switching signal SW for switching over from the first gate driver 30 to the second gate driver 40, in accordance with the judging made by the gate output judging section 71. In other words, the control section 70 also functions as switching means for switching over the first gate deriver 30 to the second gate driver 40. Moreover, the control section 70 supplies, to the informing section 80, an error flag for informing an abnormal state. Details of the control section 70 will be described later.

The informing section 80 has a function of informing a user of a failure in a gate driver. The informing section 80 can inform the user of such a failure by employing a conventional informing method such as turning on an LED lamp, displaying an error message, or making an error sound.

The liquid crystal display device 1 includes a level shifter 72, which causes a logic level to be shifted to a gate driving level or vice versa, between the first gate driver 30 and the second gate driver 40 (see FIG. 1). Note, however, that the level shifter 72 can be provided in the control section 70. Alternatively, both the level shifter 72 and the control section 70 can be provided in the source driver 20.

According to the present embodiment, horizontal scanning time periods are sequentially allocated to the respective plurality of gate lines during an active time period (effective scanning time period) of a cyclically-repeated vertical scanning time period. This causes the plurality of gate lines to be sequentially scanned.

For the scanning, the gate driver (30, 40) causes each gate signal for turning on a corresponding one of the plurality of TFTs 13 to be sequentially supplied to a corresponding one of the plurality of gate lines 12 in synchronization with a corresponding one of the horizontal scanning time periods.

Further, the source driver 20 supplies each source signal to a corresponding one of the plurality of source bus lines 11. The source signal is obtained by (i) allocating video signals, which are supplied from outside the liquid crystal display device 1 to the source driver 20 via the control section 70, to the plurality of source bus lines 11, and then (ii) carrying out a process, such as a process for stepping up a voltage, with respect to the video signals thus allocated to the plurality of source bus lines 11.

Figure 3:
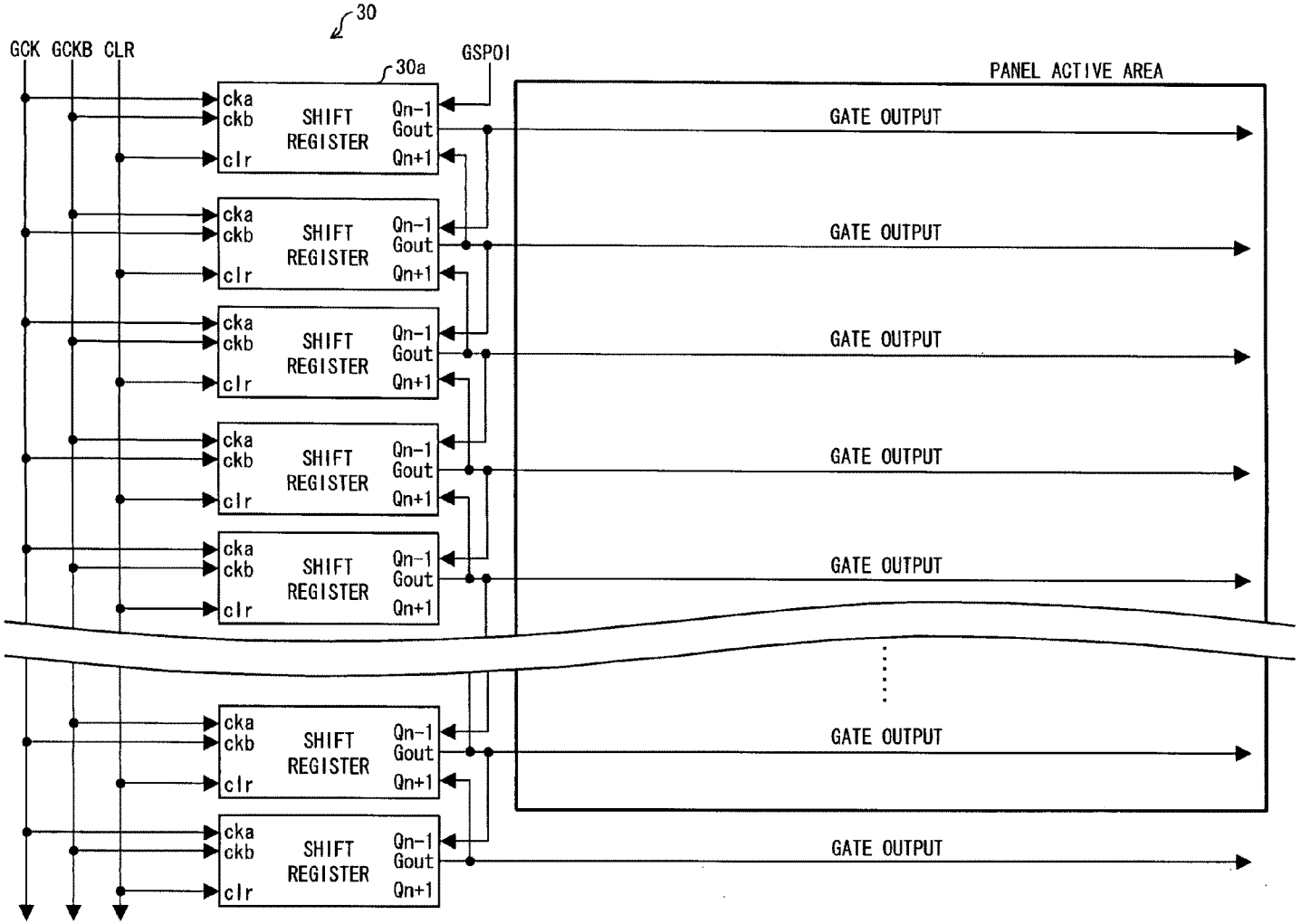
FIG. 3 is a block diagram illustrating an arrangement of a gate driver of the liquid crystal display device illustrated in FIG. 1.
Figure 21:
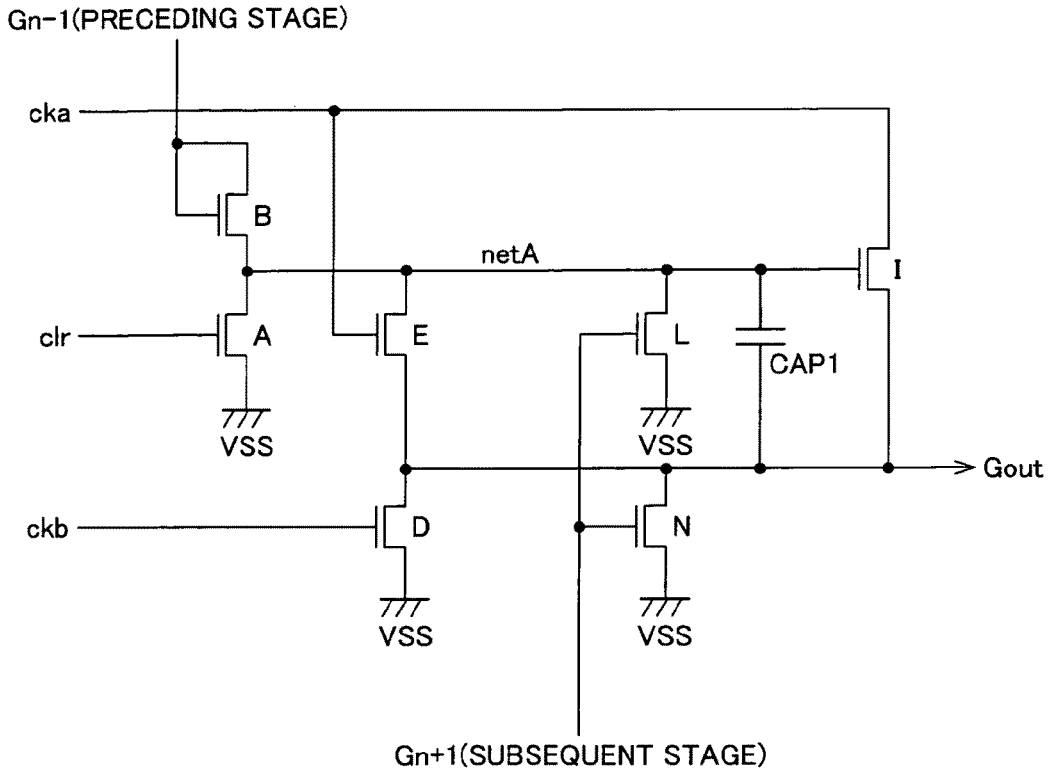
FIG. 21 is a circuit diagram illustrating an internal arrangement of each of plurality of shift registers which constitute the gate driver illustrated in FIG. 3.
Figure 22:
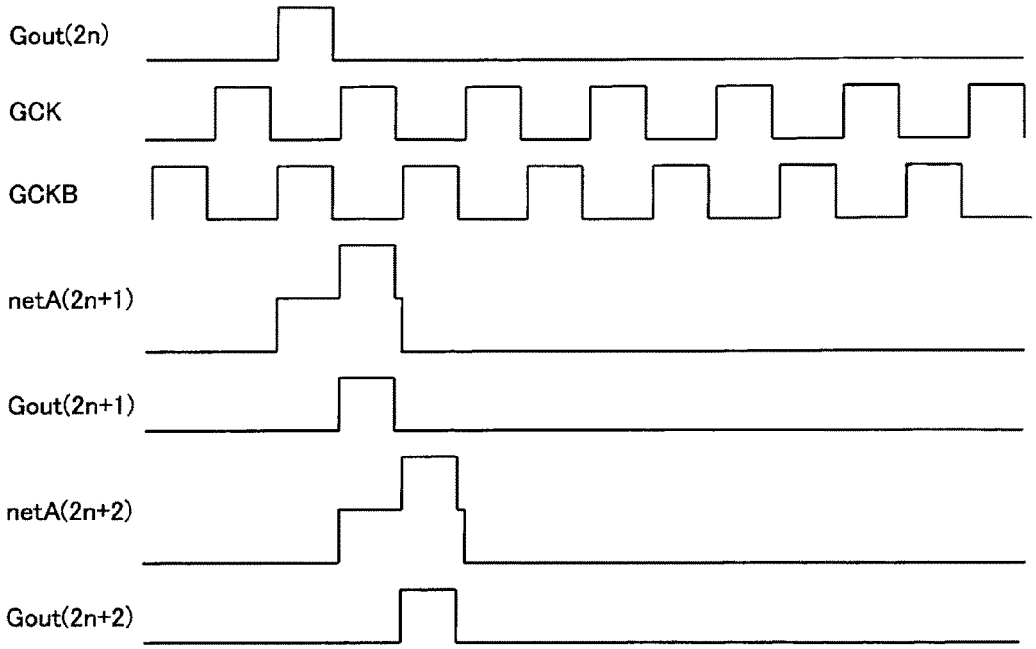
FIG. 22 is a timing chart showing an example of how the shift register illustrated in FIG. 21 operates.

Note that the gate driver (30, 40) has an arrangement identical with that of a conventional gate driver illustrated in FIGS. 3, 21, and 22, and therefore explanations of the arrangement are omitted here.

(Example of how Liquid Crystal Display Device 1 Operates)

The following description deals with a specific arrangement of the control section 70 and an operation example of the liquid crystal display device 1. The liquid crystal display device 1 has a resolution of 800RGB×480 (WVGA), for example.

Figure 4:
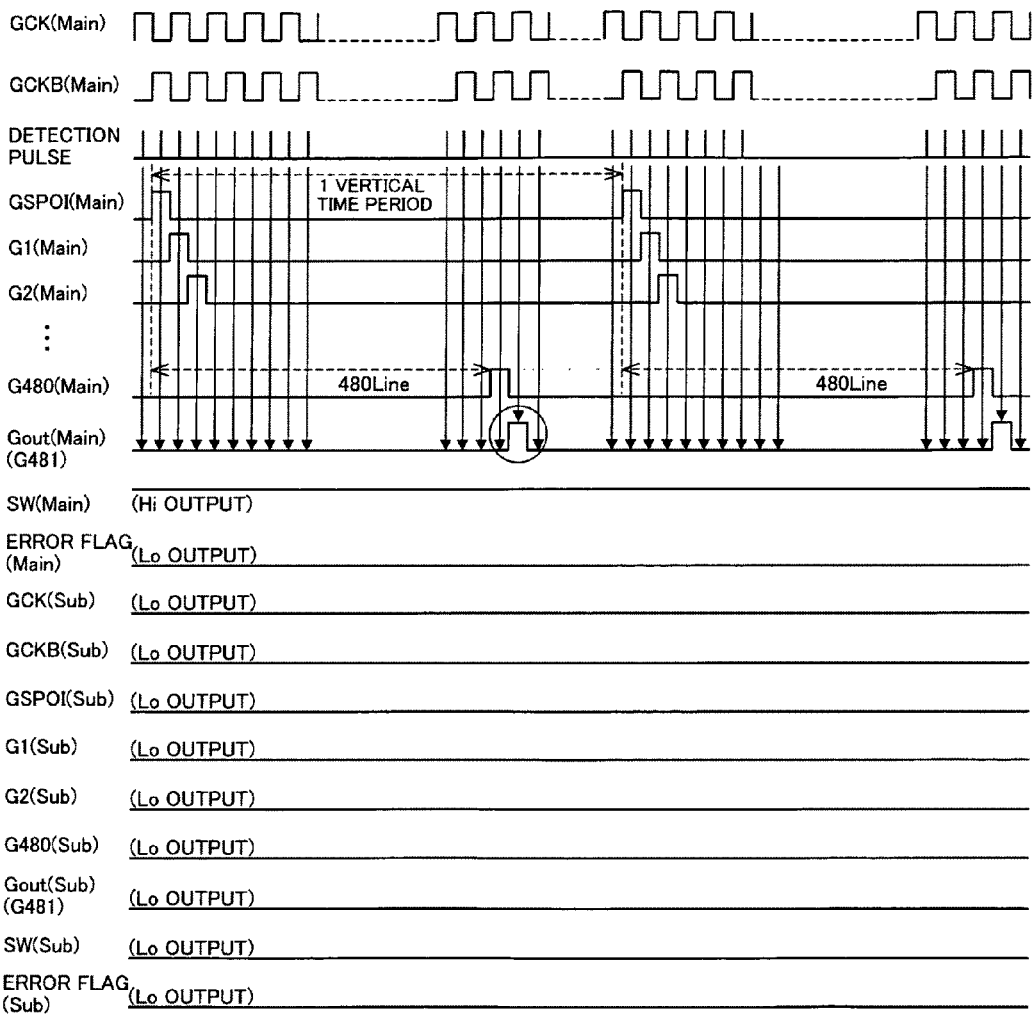
FIG. 4 is a timing chart showing various signals used by a control section and first and second gate drivers of the liquid crystal display device illustrated in FIG. 1 while the first gate driver operates without any problem.
Figure 5:
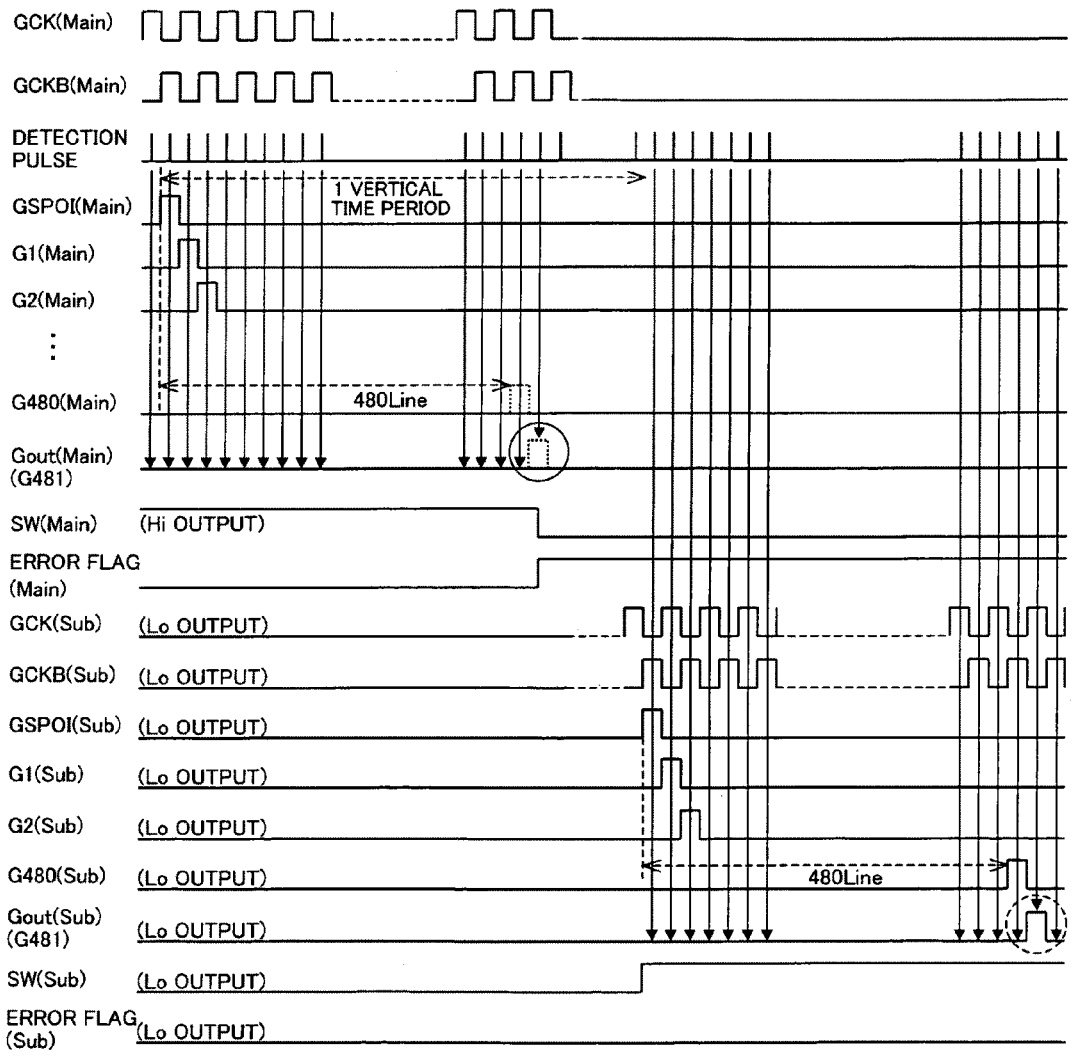
FIG. 5 is a timing chart showing various signals used by the control section and the first and second gate drivers of the liquid crystal display device illustrated in FIG. 1 in a case where the first gate driver has a failure.

FIG. 4 is a timing chart showing various signals in the control section 70, the first gate driver 30, and the second gate driver 40, while the first (main) gate driver 30 is normally operating. FIG. 5 is a timing chart showing various signals in the control section 70, the first gate driver 30, and the second gate driver 40, in a case where the first (main) gate driver 30 has a failure.

In the timing charts, (i) GCK and GCKB indicate respective clock signals, (ii) GSPOI indicates a gate start pulse, and (iii) G1, G2, . . . G480, and GOUT (481) indicate a first gate signal, a second gate signal, . . . a 480th (last) gate signal, and a 481st (which corresponds to the dummy line 12*a* provided outside an active area 10*a*) gate signal, respectively. A detection pulse is a signal for triggering periodical detection of a high (Hi) level/low (Lo) level of each gate signal supplied to a corresponding one of the plurality of gate lines 12. In the present embodiment, the level of the gate signal is detected per horizontal scanning time period. SW indicates a gate driver switching signal supplied to the gate driver. While SW is at a high (Hi) level, the switching section is turned on (in an ON state). It follows that the gate driver is in an active state. In contrast, while SW is at a low (Lo) level, the switching section is turned off (in an OFF state). It follows that the gate driver is in a non-active state. An error flag is outputted in synchronization with timing when the gate driver switching signal SW is switched from the Hi level to the Lo level.

For each of the signals, the "(Main)" indicates that signal is inputted into/outputted from the first (main) gate driver 30, while the "(Sub)" indicates that signal is inputted into/outputted from the second (sub) gate driver 40.

The following description first deals with a case where the first (main) gate driver 30 normally operates, with reference to FIGS. 1 and 4.

SW (Main) is initially set to the Hi level, while SW (Sub) is initially set to the Lo level. This turns on the first switching section 50 and turns off the second switching section 60. It follows that the first gate driver 30 is in an active state, while the second gate driver 40 is in a non-active state. A first shift register 30*a* (see FIG. 3) is set in response to GSPOI (Main) supplied to the first gate driver 30 from the control section 70. Under the circumstances, the gate signal G1 is outputted in response to the first shift register 30*a* receiving a Hi pulse via its terminal cka (i.e. GCK becomes the Hi level). The next (second) shift register 30*a* is set by the gate signal G1. The gate signal G2 is outputted in response to the second shift register 30*a* receiving the Hi pulse via its terminal cka (i.e. GCKB is turned to be at the Hi level). Similarly, the output pulse (gate signal) is sequentially shifted until the last 480th shift register 30*a* (the 480th stage) outputs its gate signal G480. The 480th gate signal G480 (Main) is supplied to (i) the gate line 12 corresponding to the 480th stage and (ii) the shift register 30*a* corresponding to the dummy line 12*a*. The 481st gate signal G481 (Main) is supplied from the shift register 30*a* to the control section 70.

Upon reception of the 481st gate signal G481 (Main), the gate output judging section 71 of the control section 70 judges whether or not the gate signal is outputted at normal (predetermined) timing. Specifically, by monitoring the 481st gate signal G481 (Main), per horizontal scanning time period, by use of the detection pulse as a trigger, the gate output judging section 71 judges (i) whether or not the 481st gate signal G481 (Main) is outputted at timing when the time corresponding to 481 lines (481 horizontal scanning time periods) has elapsed since GSPOI (Main) was outputted, and (ii) whether or not the 481st gate signal G481 (Main) is outputted at timing other than the timing when the time corresponding to 481 lines (481 horizontal scanning time periods) has elapsed since GSPOI (Main) was outputted. In a case where the gate output judging section 71 judges that the 481st gate signal G481 (Main) is not outputted at the normal timing, the control section 70 judges that the first gate driver 30 has a failure, and then switches the gate driver switching signal SW (Main) from the Hi level to the Lo level (later described with reference to FIG. 5).

In case of FIG. 4, the 481st gate signal G481 (Main) is outputted at the normal timing (when the time corresponding to 481 lines (481 horizontal scanning time periods) has elapsed) (see a circled part of FIG. 4). In this state, it is judged that the first gate driver 30 is normal, and therefore the gate driver switching signal SW (Main) is maintained at the Hi level, and the error flag (Main) is maintained at the Lo level.

Therefore, GSPOI (Main) is supplied again from the control section 70 to the first gate driver 30 in the next frame, and then the process described above is repeated. That is, since the first gate driver 30 has no failure in the case shown in FIG. 4, the process is repeated by the first gate driver 30 without the switchover from the first gate deriver 30 to the second gate driver 40. In this state, each of the signals inputted into/outputted from the second gate driver 40 is maintained at the Lo level. Note that the error flag (Main) and the error flag (Sub), which are supplied to the informing section 80, are at the Lo level. Therefore, for example, both of the LED lamp (Main) for the first gate driver 30 and the LED lamp (Sub) for the second gate driver 40 emit "green light", which indicates the normal state.

Next, the following description deals with a case where the first (main) gate driver 30 has a failure while the liquid crystal display device 1 is in use, with reference to FIGS. 1 and 5. FIG. 5 shows a state where (i) the shift register 30*a* has a failure (a state where the shifting operation cannot be carried out properly, for example), (ii) the 480th gate signal G480 is therefore not outputted, and (iii) the 481st gate signal G481 is not outputted at the normal timing (see a part indicated by a dotted line, circled with a full line in FIG. 5).

In this case, the gate output judging section 71 judges that the first gate driver 30 has a failure because the 481st gate signal G481 is not outputted to the gate output judging section 71 at the normal timing (timing when the time corresponding to 481 lines (481 horizontal scanning time periods) has elapsed since GSPOI (Main) was outputted). In response to the judging, the control section 70 (i) switches the gate driver switching signal SW (Main) from the Hi level to the Lo level and (ii) switches the error flag (Main) from the Lo level to the Hi level. This turns off the first switching section 50, and therefore the first gate driver 30 is changed into the non-active state from the active state. Then, the first gate driver 30 stops operating. Simultaneously, the informing section 80 informs outside a message indicating that the first gate driver 30 has a failure. For example, the LED lamp (Main) for the first gate driver 30 emits "red light", indicating an abnormal state, instead of "green light", indicating the normal state. This allows a user to recognize that the first gate driver 30 has a failure.

Next, the control section 70 (i) starts outputting GCK (Sub) and GCKB (Sub), and (ii) switches the gate driver switching signal SW (Sub) from the Lo level to the Hi level in synchronization with start timing of the next frame. This causes the second switching section 60 to be turned on so that the second gate driver 40 is changed into the active state from the non-active state. Simultaneously, the control section 70 supplies GSPOI (Sub) to the second gate driver 40 so as to set the first shift register 40*a* (not illustrated). After that, the output pulse (gate signal) is shifted sequentially, and the last (480th) shift register 40*a* finally outputs the 480th gate signal G480 (Sub). The 480th gate signal G480 (Sub) is supplied to (i) the last gate line 12 and (ii) the shift register 40*a* corresponding to the dummy line 12*a*. The 481st gate signal G481 (Sub) is supplied from the above shift register 40*a* to the control section 70.

The gate output judging section 71 of the control section 70 monitors the gate signal G481 (Sub), per horizontal scanning time period, by use of the detection pulse as a trigger, so as to judge (i) whether or not the gate signal G481 (Sub) is outputted at timing when the time corresponding to 481 lines (481 horizontal scanning time periods) has elapsed since GSPOI (Sub) was outputted and (ii) whether or not the gate signal G481 (Sub) is outputted at timing other than the timing when the time corresponding to 481 lines (481 horizontal scanning time periods) has elapsed since GSPOI (Sub) was outputted. In FIG. 5, it is judged that the second driver 40 is normal because the 481st gate signal G481 (Sub) is outputted at the normal timing (see a part circled with a dotted line shown in FIG. 5). It follows that the gate driver switching signal SW (Sub) is maintained at the Hi level, and the error flag (Sub) is maintained at the Lo level.

Therefore, the control section 70 supplies again GSPOI (Sub) to the second gate driver 40 in the next frame, and the process described above is repeated. That is, since the second gate driver 40 has no failure in the case shown in FIG. 5, the process is repeated by the second gate driver 40. In this state, each of the signals inputted into/outputted from the first gate driver 30 which has been determined as having a failure is maintained at the Lo level.

Here, in a case where the gate output judging section 71 judges that the 481st gate signal G481 (Sub) is not outputted at the normal timing, the control section 70 judges that the second gate driver 40 has a failure, and switches the gate driver switching signal SW (Sub) from the Hi level to the Lo level. This turns off the second switching section 60, so that the second gate driver 40 changes from the active state into the non-active state. Then, the second driver 40 stops operating. Further, the control section 70 changes the error flag (Sub) from the Lo level to the Hi level. It follows that the informing section 80 informs outside a message indicating that the second gate driver 40 has a failure. For example, the LED lamp (Sub) for the second gate driver 40 emits "red light", indicating the abnormal state, instead of "green light", indicating the normal state. As a result, both of the LED lamp (Main) for the first gate driver 30 and the LED lamp (Sub) for the second gate driver 40 emit "red light", so that the user can recognize that each of the first gate driver 30 and the second gate driver 40 has a failure.

Figure 6:
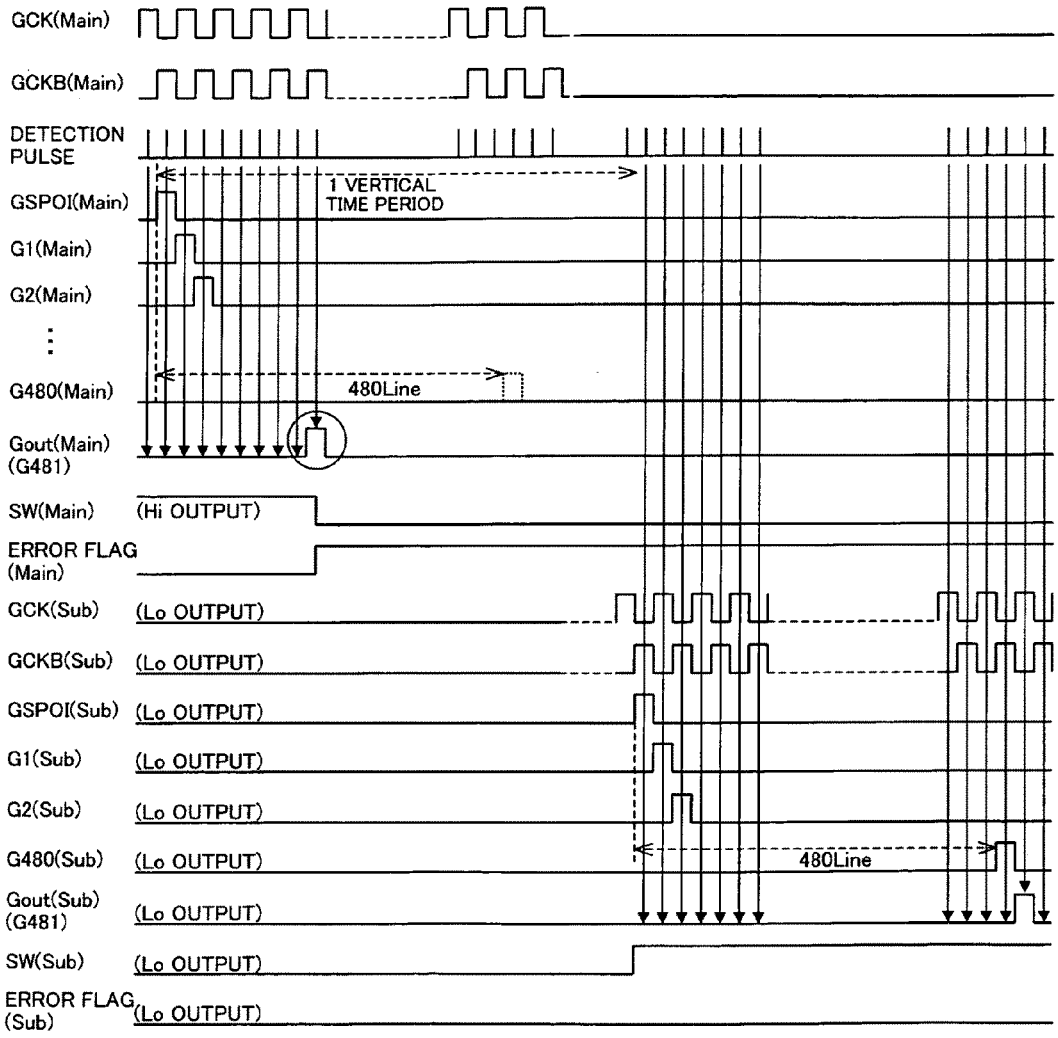
FIG. 6 is a timing chart showing another example in the case where the first gate driver illustrated in FIG. 5 has a failure.

In FIG. 5, the gate signal G480 is not outputted due to a failure in the shifting operation of the shift register 30*a*. Note that alternative examples of such a failure encompass (i) a case where the gate signal G481 is outputted at improper timing as shown in FIG. 6 (see a circled part of FIG. 6) and (ii) a case where the gate signal G481 is outputted both at the normal timing and at the abnormal timing. In this regard, the gate output judging section 71 of the liquid crystal display device 1 can successfully detect such a failure in the gate drivers because it judges both (i) whether or not the gate signal G481 is outputted at timing when the time corresponding to 481 lines (481 horizontal scanning time periods) has elapsed since GSPOI was outputted and (ii) whether or not the gate signal G481 is outputted at timing other than the timing when the time corresponding to 481 lines (481 horizontal scanning time periods) has elapsed since GSPOI was outputted.

Note that it is possible to improve the detection accuracy by shortening a cycle of the detection pulse. Specifically, it is possible to use two or more detection pulses (rising edges) during 1 horizontal scanning time period (see FIG. 4). This makes it possible to detect an improper pulse having a narrower pulse width, for example.

Alternatively, the gate output judging section 71 can judge that a gate driver has a failure, when the number of times of the consecutive judgments that the gate signal is not normally outputted reaches a predetermined number of times. This is achieved by the following configuration. Specifically, the control section 70 further includes a counting section (counting means) 73 (see FIG. 1) for counting the number of times of the judgments, made by the gate output judging section 71, that the gate signal is not normally outputted. The gate output judging section 71 judges that the gate driver has a failure when the number of times that the gate signal is not outputted normally, counted by the counting section 73, reaches a predetermined number of times (a plurality of number of times).

According to the present embodiment, the gate signal, which (i) is supplied (returned) from the gate driver to the gate output judging section 71 and (ii) is to be subjected to the detection of failure, is the gate signal G481 of the 481st stage (dummy line 12*a*), that follows the last gate line 12 among the plurality of gate lines which contribute to display. Note, however, that the present embodiment is not limited to this, and the last gate signal G480 can be supplied to the gate output judging section 71, instead of the gate signal G481. Alternatively, it is possible to (i) sequentially supply each gate signal Gout for each shift register to the gate output judging section 71 and (ii) judge, for each shift register, whether the gate signal Gout is not normally outputted. Note, however, that in a case where the gate signal G480 of the last shift register or the gate signal Gout of each shift register is supplied to the gate output judging section 71, a load capacitor of the gate line 12 becomes larger. This may cause deterioration in the display quality. For this reason, it is preferable to supply, to the gate output judging section 71, only a gate signal of the nth dummy line following the last gate line such as a first dummy line following the last gate line or a second dummy line following the last gate line.

Further, the gate output judging section 71 of the present embodiment judges (i) whether or not the gate signal G481 (Main) is outputted at timing when the time corresponding to 481 lines (481 horizontal scanning time periods) has elapsed since GSPOI (Main) was outputted and (ii) whether or not the gate signal G481 is outputted at timing other than the timing when the time corresponding to 481 lines (481 horizontal scanning time periods) has elapsed since GSPOI (Main) was outputted. Note, however, that the present embodiment is not limited to this. For example, in a case where the time period from a time when GSPOI (Main) is outputted to a time when the gate signal G1 (Main) is outputted is not equal to 1 horizontal scanning time period, it is preferable to arrange the gate output judging section 71 to judge (i) whether or not the gate signal G481 (Main) is outputted at timing when the time corresponding to 480 lines (480 horizontal scanning time periods) has elapsed since the gate signal G1 (Main) was outputted (since the scanning was started) and (ii) whether or not the gate signal G481 (Main) is outputted at timing other than the timing when the time corresponding to 480 line (480 horizontal scanning time periods) has elapsed since the gate signal G1 (Main) was outputted (since the scanning was started).

Figure 7:
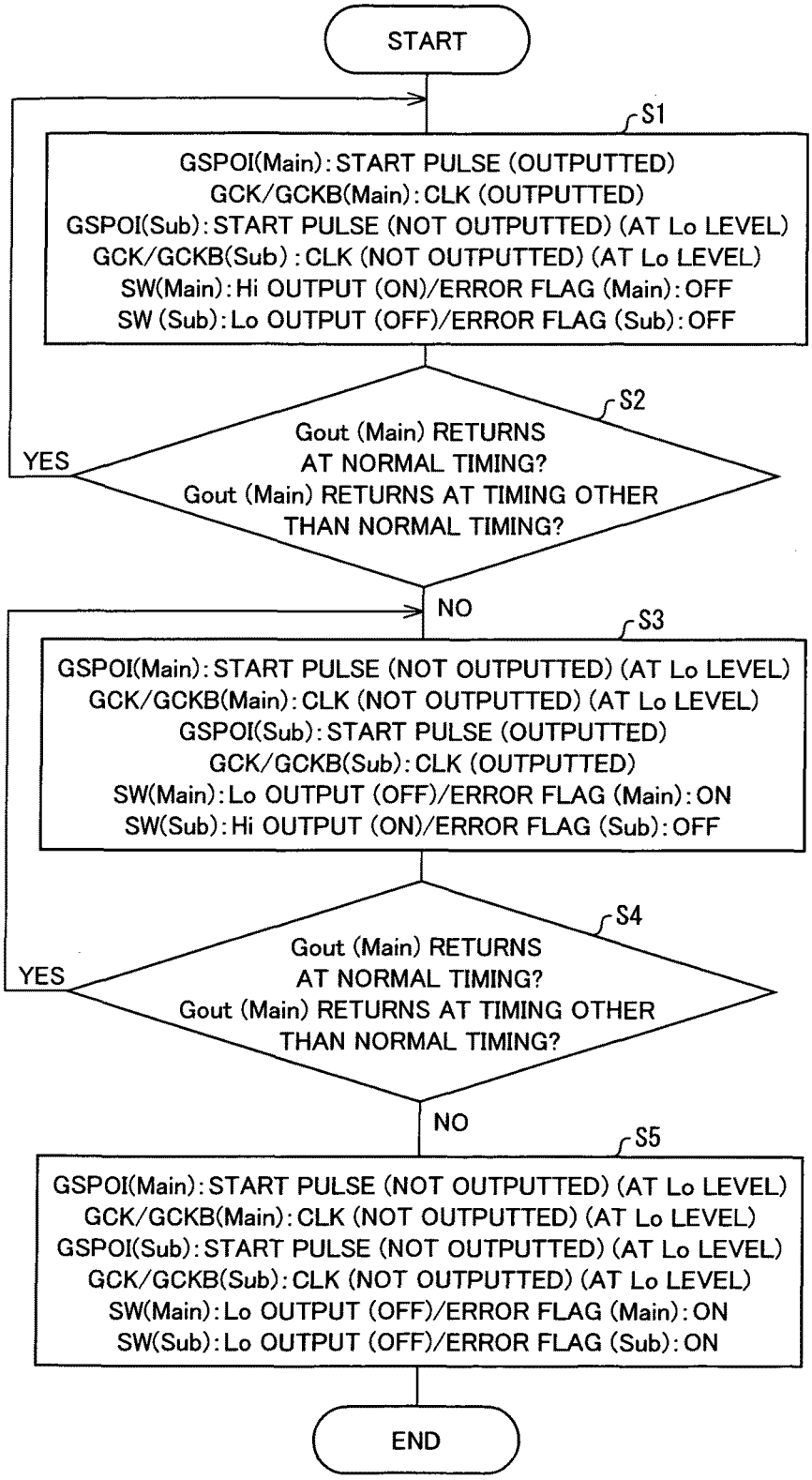
FIG. 7 is a flowchart showing an example of how the liquid crystal display device illustrated in FIG. 1 operates.

FIG. 7 is a flowchart showing an example of how the foregoing operation is carried out. First, the control section 70 outputs a gate start pulse GSPOI (Main), a clock GCK (Main), and a clock GCKB (Main) (Step S1) (see FIG. 7). FIG. 4 shows their output waveforms. Further, the control section 70 outputs a gate driver switching signal SW (Main) which is at the Hi level and a gate driver switching signal SW (Sub) which is at the Lo level in Step S1. Here, the control section 70 also outputs a gate start pulse GSPOI (Sub), a clock GCK (Sub), a clock GCKB (Sub), an error flag (Main) and an error flag (Sub), each of which is at the Lo level.

Next, the gate output judging section 71 judges (i) whether or not a gate signal Gout (Main) is outputted at normal timing and (ii) whether or not the gate signal Gout (Main) is outputted at timing other than the normal timing (Step S2).

In a case of YES in Step S2 (i.e. in a case where the gate signal Gout (Main) is outputted at the normal timing and is not outputted at the timing other than the normal timing), it is judged that the gate driver 30 is normal. Then, the process is returned to Step S1, and a normal operation is repeated by the gate driver 30.

In contrast, in a case of NO in Step S2 (i.e. in a case where (i) the gate signal (Main) is not outputted at the normal timing, (ii) the gate signal Gout is outputted at the timing other than the normal timing, or (iii) the gate signal Gout is outputted both at the normal timing and at the timing other than the normal timing), it is judged that the first gate driver 30 has a failure. Then, the process proceeds to Step S3.

The control section 70 switches, in accordance with the judgment made by the gate output judging section 71 (the failure of the first gate driver 30), (i) a gate driver switching signal SW (Main) from the Hi level to the Lo level, (ii) a gate driver switching signal SW (Sub) from the Lo level to the Hi level, (iii) the gate start pulse GSPOI (Main) from the Hi level to the Lo level, (iv) each of the clock GCK (Main) and the clock GCKB (Main) from the Hi level to the Lo level so that each of the gate start pulse GSPOI (Sub), the clock GCK (Sub), and the clock GCKB (Sub) is changed in an output mode (Step S3) (see FIG. 5).

Furthermore, the control section 70 switches the error flag (Main) from the Lo level to the Hi level in accordance with the judgment made by the gate output judging section 71. Note that the error flag (Sub) is maintained at the Lo level. This causes (i) the first gate driver 30 to stop operating and (ii) the second gate driver 40 to start operating. Simultaneously, the failure of the first gate driver 30 is informed outside.

Then, the gate output judging section 71 monitors output timing of the gate signal Gout (Sub) of the second gate driver 40 in a manner similar to Step S2 so as to judge how the second gate driver 40 operates (Step S4).

It is judged that the second gate driver 40 is normal, in a case of Yes in Step S4 (i.e. in a case where the gate signal Gout (Sub) is outputted at the normal timing and is not outputted at the timing other than the normal timing). Then, the process is returned to Step S3, and the normal operation is repeated by the second gate driver 40.

In contrast, it is judged that the second gate driver 40 has a failure, in a case of No in Step S4 (i.e. in a case where (i) the gate signal Gout (Sub) is not outputted at the normal timing, (ii) the gate signal Gout (Sub) is outputted at the timing other than the normal timing, or (iii) the gate signal Gout (Sub) is outputted both at the normal timing and at the timing other than the normal timing). Then, the process proceeds to Step S5.

The control section 70 switches, in accordance with the judgment made by the gate output judging section 71 (the failure of the second gate driver 40), (i) the gate driver switching signal SW (Sub) from the Hi level to the Lo level, (ii) the gate start pulse GSPOI (Sub) from the Hi level to the Lo level, (iii) the clock signals GCK (Sub) and GCKB (Sub) from the Hi level to the Lo level, and (iv) the error flag (Sub) from the Lo level to the high level (Step S5). This causes the second gate drivers 40 to stop operating, in addition to the first gate driver 30 whose operation has been already stopped. Then, the failure of each of the first gate driver 30 and the second gate driver 40 is informed outside.

The liquid crystal display device of the present embodiment thus includes, in addition to an arrangement of a general liquid crystal display device: the redundant circuit (second gate driver 40); the gate output judging section 71; and the control section 70 for controlling these. This causes the liquid crystal display device of the present embodiment to automatically switch over the first gate driver 30 to the second gate driver 40 in a case where the first gate driver 30 has a failure. Therefore, the liquid crystal display device of the present embodiment can operate without suspending its display function in a case where the first gate driver 30 has a failure. Accordingly, it is possible to (i) omit a step of switching the gate driver to the redundant circuit while a liquid crystal display device is being manufactured and (ii) extend a lifetime of the liquid crystal display device, during which the liquid crystal display device can be used by a user. Moreover, it is possible to obtain an advantage of preventing Vth of one of the gate drivers, which is not in operation, from shifting, by setting each signal related to the one of the gate drivers to the Lo level while the other of the gate drivers is in operation.

The present embodiment describes a case where the switchover of the gate driver is carried out. Note, however, that the present embodiment is not limited to this. For example, the present embodiment is applicable to a liquid crystal display device in which (i) a plurality of source drivers are provided, (ii) it is judged whether or not the plurality of source drivers have their respective failures, and (iii) the switchover to a normal one of the plurality of source drivers is carried out in a case where it is judged that any of the plurality of source drivers has a failure. The following Embodiment 2 deals with a liquid crystal display device including a plurality of gate drivers and a plurality of source drivers.

Embodiment 2

A liquid crystal display device of the present invention is not limited to the one that includes a monolithic circuit described in Embodiment 1, and can be the one that includes a plurality of gate chip drivers and a plurality of source chip drivers. Embodiment 2 deals with such a liquid crystal display device with reference to FIGS. 8 through 19. Note that members having functions identical with those of the members described in Embodiment 1 have the same signs as in Embodiment 1, and their explanations are omitted here for convenience. Further, terms defined in Embodiment 1 are used in Embodiment 2 in the same way as in Embodiment 1, unless otherwise noted.

Figure 8:
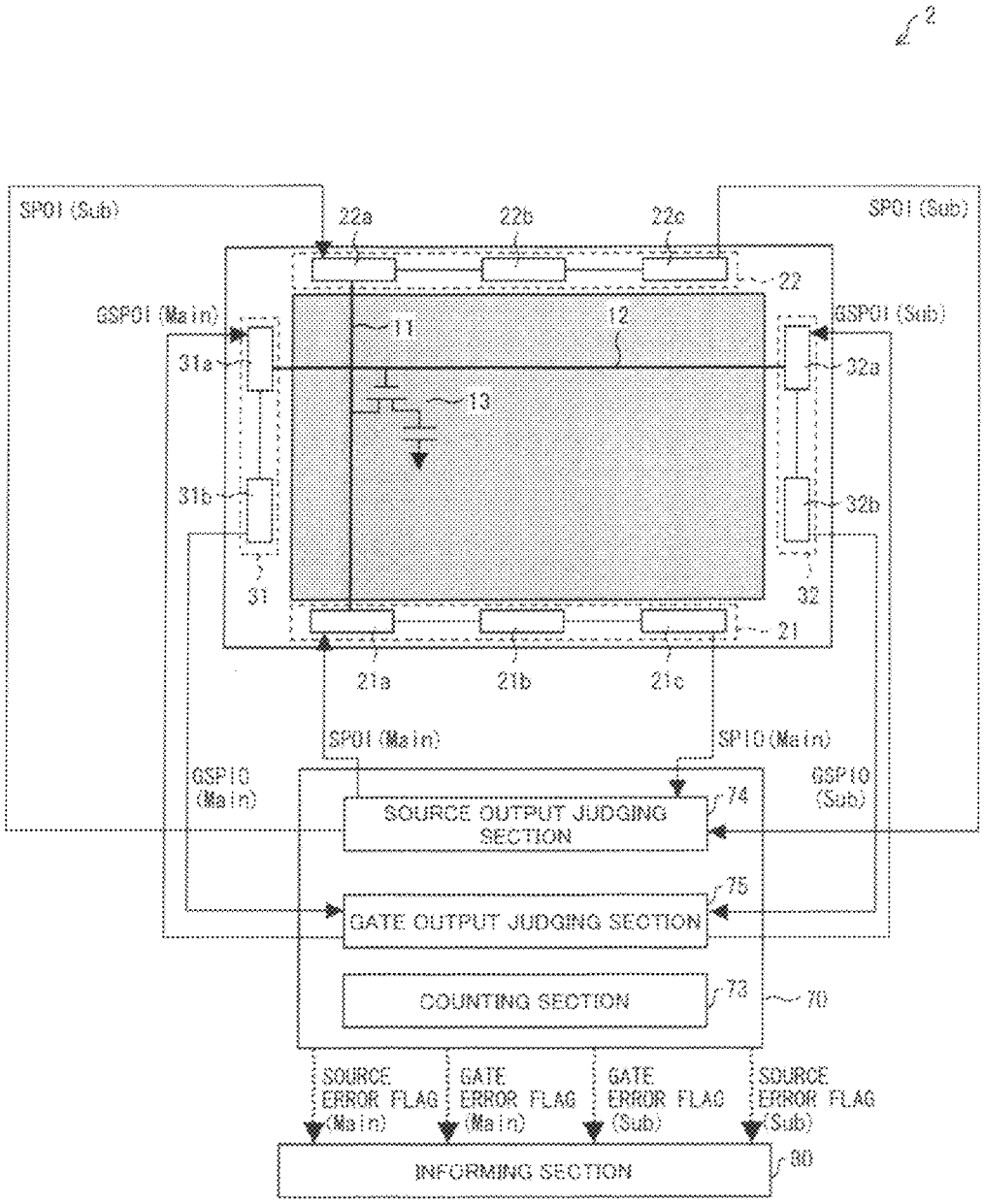
FIG. 8 is a block diagram illustrating an arrangement of a liquid crystal display device in accordance with Embodiment 2 of the present invention.

FIG. 8 is a block diagram illustrating an entire arrangement of a liquid crystal display device 2. The liquid crystal display device 2 includes an active matrix liquid crystal panel 10, a first source driver 21, a second source driver 22, a first gate driver 31, a second gate driver 32, a control section 70, and an informing section 80.

The first source driver 21 and the second source driver 22 have identical functions, and share a plurality of source lines 11 to which they are connected. Further, the first gate driver 31 and the second gate driver 32 have identical functions, and share a plurality of gate lines 12 to which they are connected. That is, the first source driver 21 and the second source driver 22 are arranged to have redundancy, and the first gate driver 31 and the second gate deriver 32 are arranged to have redundancy. Hereinafter, the first source driver 21 is referred to as "main source driver 21", the second source driver 22 is referred to as "sub source driver 22 (redundant circuit)", the first gate driver 31 is referred to as "main gate driver 31", and the second gate driver 32 is referred to as "sub gate driver 32 (redundant circuit)", if necessary.

The first source driver 21 includes a plurality of first source chip drivers. Specifically, the first source driver 21 of the present embodiment includes three first source chip drivers 21*a*, 21*b*, and 21*c*. Similarly, the second source driver 22 includes a plurality of second source chip drivers. Specifically, the second source driver 22 of the present embodiment includes three second source chip drivers 22*a*, 22*b*, and 22*c*.

The first gate driver 31 includes a plurality of first gate chip drivers. Specifically, the first gate driver 31 of the present embodiment includes two first gate chip drivers 31*a* and 31*b*. Similarly, the second gate driver 32 includes a plurality of second gate chip drivers. Specifically, the second gate driver 32 of the present embodiment includes two second gate chip drivers 32*a* and 32*b*.

The control section 70 includes, in addition to a general function (not illustrated) of controlling the first gate driver 31, the second gate driver 32, the first source driver 21, and the second source driver 22: (i) a source output judging section 74 for monitoring a source signal outputted from each of the first source driver 21 and the second source driver 22 so as to judge whether or not the timing at which the source signal is outputted is normal, and (ii) a gate output judging section 75 for monitoring a gate signal outputted from each of the first gate driver 31 and the second gate driver 32 so as to judge whether or not the timing at which the gate signal is outputted is normal. In a case where the source output judging section 74 judges that the source signal is outputted improperly, normal display cannot be expected. Accordingly, it is judged that the source driver has a failure. In a case where the gate output judging section 75 judges that the gate signal is outputted at improper timing, an image cannot be displayed normally. Accordingly, it is judged that the gate driver has a failure.

Further, the control section 70 switches over (i) the first source driver to the second source driver 22 in accordance with the judgment made by the source output judging section 74 and (ii) the first gate driver 31 to the second gate driver 32 in accordance with the judgment made by the gate output judging section 75. That is, the control section 70 also functions as switching means for switching over (i) the first source driver 21 to the second source driver 22 and (ii) the first gate driver 31 to the second gate driver 32. Further, the control section 70 supplies, to the informing section 80, error flags (source error flag, gate error flag) each of which is used to inform outside such a failure. Details of the control section 70 will be described later.

The informing section 80 has a function of informing the user of such a failure in the source driver and the gate driver. The informing section 80 can inform the user of such a failure by employing a conventional method, such as turning on an LED lamp, displaying an error message, making an error sound, etc.

(Example of how Liquid Crystal Display Device 2 Operates)

The following description deals with a specific arrangement of the control section 70 and an example as to how the liquid crystal display device 2 operates. The liquid crystal display device 2 of the present embodiment has a resolution of 800RGB×480 (WVGA), for example.

<Switchover of Source Driver>

Figure 9:
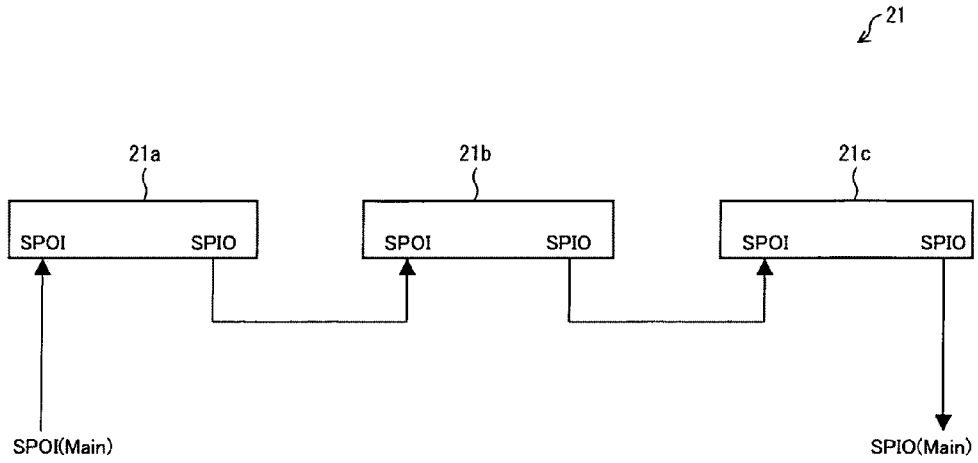
FIG. 9 is a block diagram schematically illustrating an arrangement of a source driver of the liquid crystal display device illustrated in FIG. 8.

The following description first deals with how to switch over the source driver as well as a specific arrangement of the source output judging section 74. FIG. 9 is a block diagram illustrating a schematic arrangement of each of the first source driver 21 and the second source driver 22.

The first source driver 21 is constituted by the first source chip drivers 21*a*, 21*b*, and 21*c*, which are cascade-connected to each other (see FIG. 9). The first source chip driver 21*a* starts data sampling in response to a source start pulse SPOI (Main) which is supplied from the control section 70 to the first source chip driver 21*a*. The first source chip driver 21*a* (i) carries out, in accordance with a video signal, the sampling of data signals (Digital Data) which are to be supplied to corresponding ones of a plurality of source lines 11 and (ii) supplies a source signal SPIO to the neighboring source chip driver 21*b*. The first source chip driver 21*b* starts data sampling in response to the source signal SPIO thus received. The first source chip driver 21*b* (i) carries out, in accordance with the video signal, the sampling of data signals (Digital Data) which are to be supplied to corresponding ones of a plurality of source lines 11 and (ii) supplies the source signal SPIO to the neighboring source chip driver 21*c*. The first source chip driver 21*c* starts data sampling in response to the source signal SPIO. The first source chip driver 21*c* (i) carries out, in accordance with the video signal, the sampling of data signals (Digital Data) which are to be supplied to corresponding ones of a plurality of source lines 11 and (ii) supplies the source signal SPIO (Main) to the control section 70. The source signal SPIO (Main) is supplied to the source output judging section 74 of the control section 70.

FIG. 9 illustrates an arrangement in which the sampling is carried out from a left side to a right side of FIG. 9. Note, however, that it is possible to carry out the sampling from the right side to the left side by arranging the first source driver 21 so that the source start pulse SPOI is supplied to the first source chip driver 21*c* and the output signal SPIO is outputted from the first source chip driver 21*a*.

Figure 10:
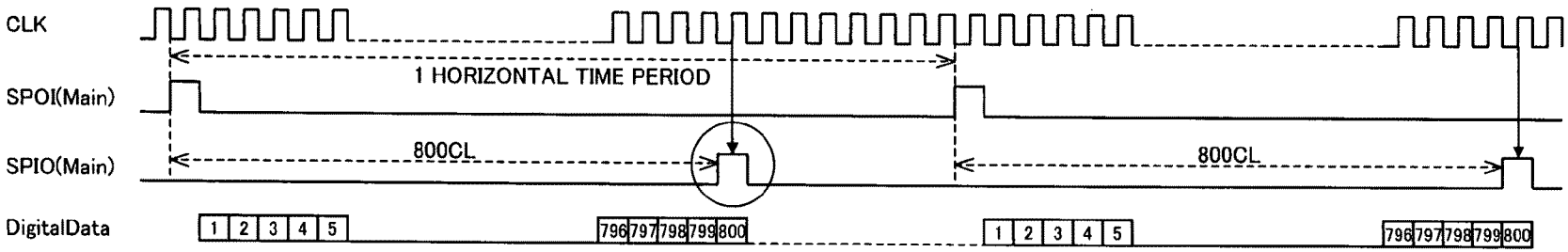
FIG. 10 is a timing chart showing various signals used by a control section and a first source driver of the liquid crystal display device illustrated in FIG. 8 while the first source driver operates without any problem.

The following description deals with a case where the first (main) source driver 21 normally operates with reference to FIGS. 8 and 10. FIG. 10 is a timing chart showing how various signals change in the control section 70 and the first source driver 21 in a case where the first source driver 21 normally operates.

First, the control section 70 supplies (i) the source start pulse SPOI (Main) to the first source chip driver 21*a* and (ii) the source start pulse SPOI (Sub) to the second source chip driver 22*a* which is at the Lo level. This causes (i) the first source driver 21 to be in an active state and (ii) the second source driver 22 to be in a non-active state. The first source chip driver 21*a* starts the sampling in sync with a clock signal CLK upon the reception of the start pulse SPOI (Main) from the control section 70. Note that the clock signal CLK is determined in accordance with a resolution of the display panel. Since the liquid crystal display device 2 of FIG. 8 has a resolution of 800RGB×480 (WVGA), the source driver carries out the sampling in sync with each of 800 clocks.

The first source chip drivers 21*a*, 21*b*, and 21*c* are sequentially driven in response to the source start pulse SPOI (Main), and the source signal SPIO (Main) is supplied from the first source chip driver 21*c* to the control section 70.

The source output judging section 74 of the control section 70 judges whether or not the source signal is outputted at normal timing. Specifically, the source output judging section 74 monitors the source signal SPIO (Main) per clock (in FIG. 10, the monitoring is carried out for each rise of CLK) so as to judge (i) whether or not the source signal SPIO (Main) is outputted at timing when the time corresponding to 800 clocks has elapsed since the source start pulse SPOI (Main) was outputted and (ii) whether or not the source signal SPIO (Main) is outputted at timing other than the timing when the time corresponding to 800 clocks has elapsed since the source start pulse SPOI (Main) was outputted. In a case where the source output judging section 74 judges that the source signal SPIO (Main) is not outputted at normal timing, it is judged that the first source driver 21 has a failure. In this case, the control section 70 switches over the source start pulse SPOI (Main) from the output state to the Lo level (later described with FIG. 12).

FIG. 10 shows a case where the source signal SPIO (Main) is outputted at the normal timing (see a circled part of FIG. 10). In this case, it is judged that the first source driver 21 is normal, and the source error flag (Main) is maintained at the Lo level.

Accordingly, the source start pulse SPOI (Main) is supplied again from the control section 70 to the first source chip driver 21*a* in the next horizontal scanning period, and the process described above is repeated. That is, since the first source driver 21 has no failure in the case shown by FIG. 10, the process is repeated by the first source driver 21 without the switchover from the first source driver 21 to the second source driver 22. Here, each of the signals inputted into/outputted from the second source driver 22 is maintained at the Lo level. Note that the source error flag (Main) and the source error flag (Sub), which are supplied to the informing section 80, are at the Lo level. Therefore, for example, an LED lamp (Main) for the first source driver 21 and an LED lamp (Sub) for the second source driver 22 emit "green light", which indicates the normal state.

Figure 11:
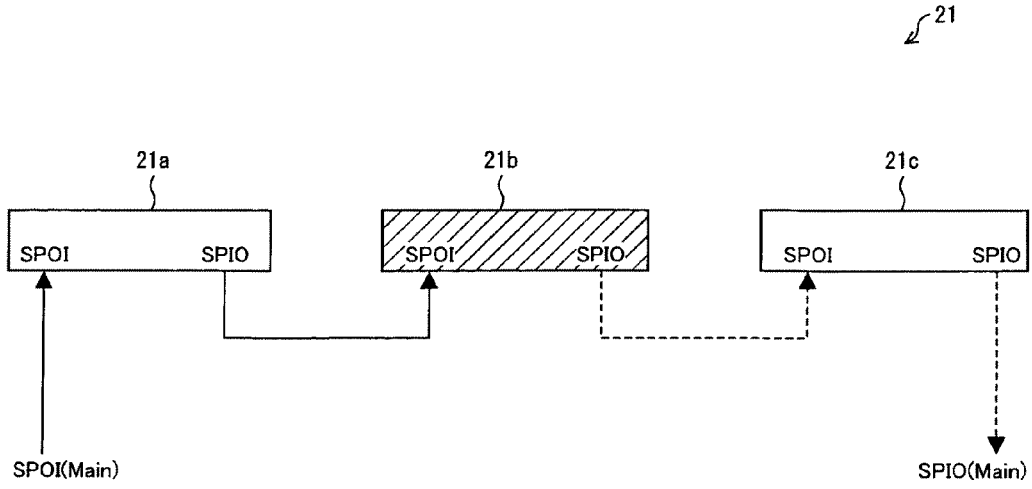
FIG. 11 is a block diagram illustrating a state where a first source chip driver included in the first source driver of the liquid crystal display device illustrated in FIG. 8 has a failure.
Figure 12:
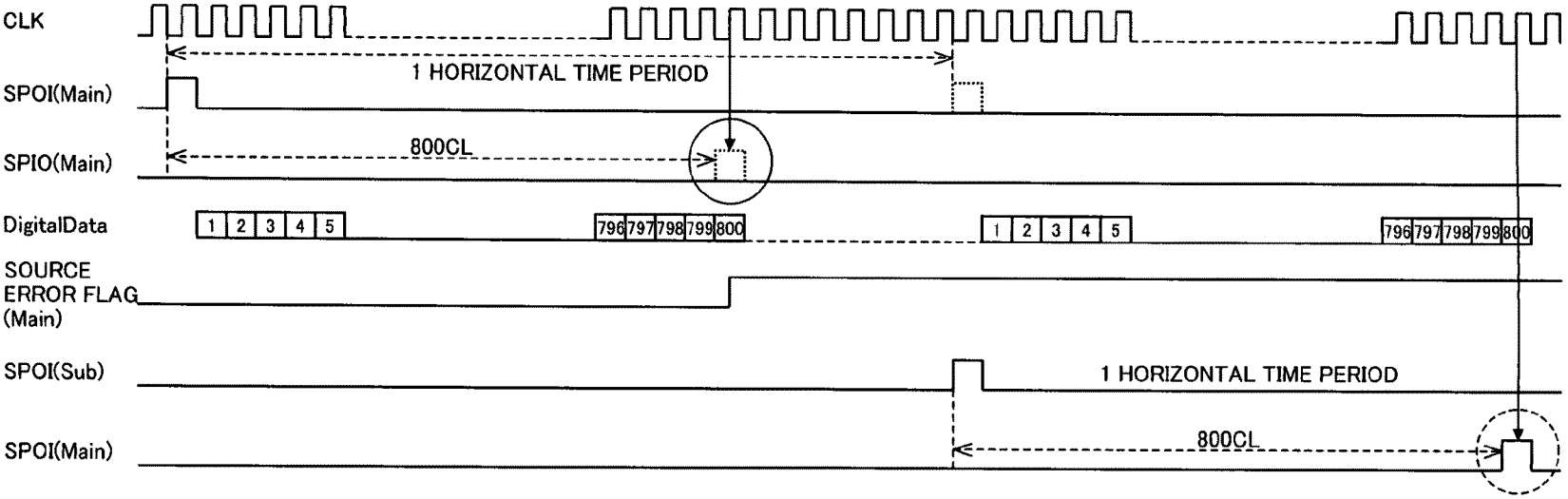
FIG. 12 is a timing chart showing various signals used by the control section and the first source driver of the liquid crystal display device illustrated in FIG. 8 in a case where the first source driver has a failure.

In contrast, the following description deals with a case where the first (main) source driver 21 has a failure, with reference to FIGS. 8, 11, and 12. Here, the first source chip driver 21*b* has a failure (see a part indicated by oblique lines in FIG. 11) and therefore the source signal SPIO is not supplied to the first source chip driver 21*c*. Accordingly, the source signal SPIO (Main) is not outputted from the last first source chip driver 21*c* at the normal timing (see a part indicated by a dotted line, circled with a full line in FIG. 12). In this case, the source output judging section 74 judges that the first source driver 21 has a failure, because the source signal SPIO (Main) is not supplied to the source output judging section 74 at the normal timing (at the timing when the time corresponding to 800 clocks has elapsed since the source start pulse SPOI (Main) was outputted). Then, the control section 70 (i) maintains the source start pulse SPOI (Main) at the Lo level and (ii) switches the source error flag (Main) from the Lo level to the Hi level. This switches the first source driver 21 from the active state to the non-active state, the first source driver 21 stops operating, and the informing section 80 informs outside a message indicating that the first source driver 21 has a failure. For example, the LED lamp (Main) for the first source driver 21 emits "red light", indicating the abnormal state, instead of "green light", indicating the normal state. This allows the user to recognize that the first source driver 21 has a failure.

Then, the control section 70 switches the source start pulse SPOI (Sub) from the Lo level to the output state by controlling the source start pulse SPOI (Sub) to be in synchronization with start timing of the next horizontal scanning time period. This causes the second source driver 22 to be switched from the non-active state to the active state. Therefore, the second source chip drivers 22*a*, 22*b*, and 22*c* of the second source driver 22 are sequentially driven, and the source signal SPIO (Sub) is supplied from the second source chip driver 22*c* to the control section 70.

The source output judging section 74 of the control section 70 monitors the source signal SPIO (Sub) per clock so as to judge (i) whether or not the source signal SPIO (Sub) is outputted at timing when the time corresponding to 800 clocks has elapsed since the source start pulse SPOI (Sub) was outputted and (ii) whether or not the source signal SPIO (Sub) is outputted at timing other than the timing when the time corresponding to 800 clocks has elapsed since the source start pulse SPOI (Sub) was outputted. FIG. 12 shows a case where the source signal SPIO (Sub) is outputted at the normal timing (see a part circled with a dotted line in FIG. 12). Therefore, it is judged that the second source driver 22 is normal and the source error flag (Sub) is maintained at the Lo level.

Accordingly, the source start pulse SPOI (Sub) is supplied again from the control section 70 to the second source driver 22 in the next horizontal scanning time period, and the process described above is repeated. That is, since the second source driver 22 has no failure in the case shown by FIG. 12, the process is repeated by the second source driver 22. Here, each of the signals inputted into/outputted from the first source driver 21 which has been judged as having a failure is maintained at the Lo level.

In a case where the source output judging section 74 judges that the source signal SPIO (Sub) is not outputted at the normal timing, it is judged that the second source driver 22 has a failure. It follows that the control section 70 maintains the source start pulse SPOI (Sub) at the Lo level. This switches the second source driver 22 from the active state to the non-active state. Then, the second source driver 22 stops operating. Further, the control section 70 switches the source error flag (Sub) from the Lo level to the Hi level. It follows that the informing section 80 informs outside a message indicating that the second source driver 22 has a failure. For example, the LED lamp (Sub) for the second source driver 22 emits "red light" which indicates the abnormal state, instead of "green light" which indicates the normal state. Accordingly, both of the LED lap (Main) and the LED lamp (Sub)

emit "red light". This allows the user to recognize that each of the first source driver 21 and the second source driver 22 has a failure.

Figure 13:
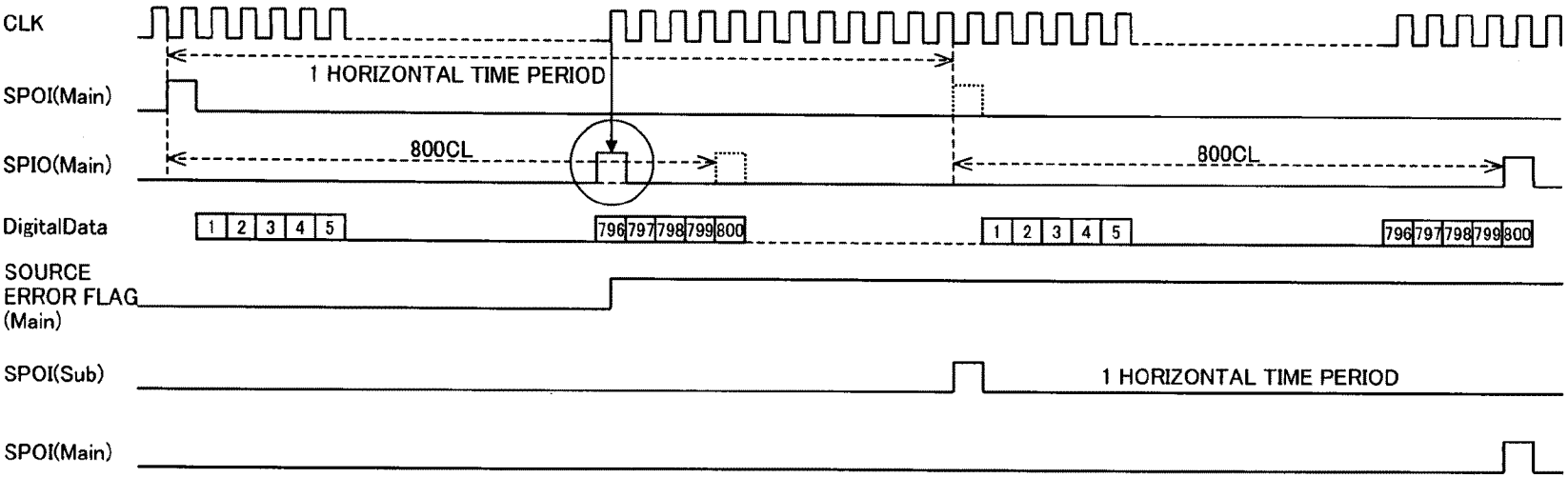
FIG. 13 is a timing chart showing another example in the case where the first gate driver illustrated in FIG. 8 has a failure.

FIG. 12 shows the case where the source signal SPIO (Main) is not outputted due to a failure in the first source chip driver 21*b*. Note, however, that examples of such a failure encompass (i) a case where the source signal SPIO (Main) is outputted at improper timing as shown in FIG. 13 and (ii) a case where the source signal SPIO (Main) is outputted both at the normal timing and at the improper timing. In this regard, the source output judging section 74 of the liquid crystal display device 2 of the present embodiment can successfully detect a failure in the source driver, because it judges (i) whether or not the source signal SPIO (Main) is outputted at timing when the time corresponding to 800 clocks has elapsed since the source start pulse SPOI (Main) was outputted, and (ii) whether or not the source signal SPIO (Main) is outputted at timing other than timing when the time corresponding to 800 clocks has elapsed since the source start pulse SPOI (Main) was outputted.

Alternatively, the source output judging section 74 can judge that the source driver has a failure, when the number of times of the consecutive judgments that the source signal SPIO (Main) is not normally outputted reaches a predetermined number of times. Like Embodiment 1, this arrangement can be realized by causing the liquid crystal display device 2 to further include a counting section 73.

According to the present embodiment, the source signal SPIO, which (i) is supplied (returned) from the source driver to the source output judging section 71 and (ii) is to be subjected to the detection of failure, is the source signal SPIO (Main) of the last 800th clock. Note, however, that the present embodiment is not limited to this, and the source signal SPIO can be supplied from the first source chip driver 21*a* or 21*b* to the source output judging section 74, for example. Alternatively, each of the source signals SPIO of the first source chip drivers 21*a*, 21*b*, and 21*c* can be sequentially supplied to the source output judging section 74 so that the source output judging section 74 judges, per source chip driver, whether or not the source signal SPIO is outputted improperly. Moreover, it is also possible to arrange such that the source output judging section 74 judges whether or not each of the data signals, supplied to each of the plurality of source lines 11, is outputted at improper timing.

Figure 14:
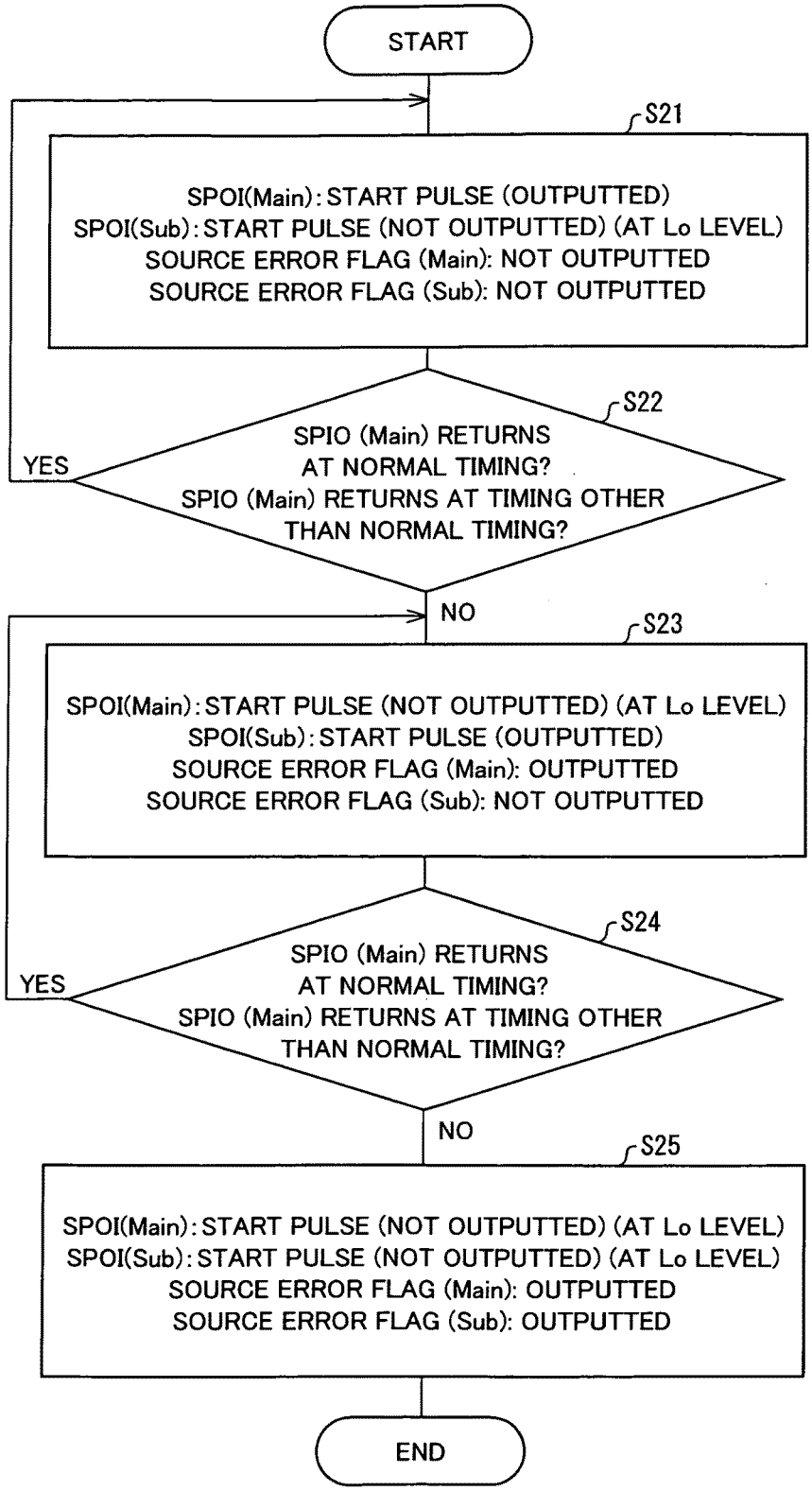
FIG. 14 is a flowchart showing an example of how the liquid crystal display device (source driver) illustrated in FIG. 8 operates.

FIG. 14 is a flowchart showing an example of the foregoing operation. The control section 70 controls the source start pulse SPOI (Main) to be in the output state (Step S21) (see FIG. 14). Here, the source start pulse SPOI (Sub), the source error flag (Main), and the source error flag (Sub) are at the Lo level.

Next, the source output judging section 74 judges (i) whether or not the source signal SPIO (Main) is outputted at normal timing and (ii) whether or not the source signal SPIO (Main) is outputted at timing other than the normal timing (Step S22).

In a case of Yes in Step S22 (i.e. in a case where the source signal SPIO (Main) is outputted at the normal timing and is not outputted at timing other than the normal timing), it is judged that the first source driver 21 is normal. Then, the process is returned to Step S21, and the normal operation is repeated by the first source driver 21.

In contrast, in a case of NO in Step S22 (i.e. in a case where (i) the source signal SPIO (Main) is not outputted at the normal timing, (ii) the source signal SPIO (Main) is outputted at timing other than the normal timing, or (iii) the source signal SPIO is outputted both at the normal timing and at timing other than the normal timing), it is judged that the first source driver 21 has a failure. Then, the process proceeds to Step S23.

In accordance with the judgment made by the source output judging section 74 (the failure in the first source driver 21), the control section 70 (i) maintains the source start pulse SPOI (Main) at the Lo level and (ii) switches the source start pulse SPOI (Sub) to the output state (Step S23). Further, the control section 70 switches the source error flag (Main) from the Lo level to the Hi level. Note that the source error flag (Sub) is maintained at the Lo level. This causes (i) the first source driver 21 to stop operating, and (ii) the second source driver 22 to start operating. Simultaneously, it is informed outside that the first source driver 21 has a failure.

Next, the source output judging section 74 monitors output timing of the source signal SPIO (Sub) so as to judge how the second source driver operates, in a manner similar to Step S22 (Step S24).

In a case of YES in Step S24 (i.e. in a case where the source signal SPIO (Sub) is outputted at the normal timing and is not outputted at timing other than the normal timing), it is judged that the second source driver 22 is normal. Then, the process is returned to Step S23, and the normal operation is repeated by the second source driver 22.

In contrast, in a case of NO in Step S24 (i.e. in a case where (i) the source signal SPIO (Sub) is not outputted at the normal timing, (ii) the source signal SPIO (Sub) is outputted at timing other than the normal timing, or (iii) the source signal SPIO (Sub) is outputted both at the normal timing and at timing other than the normal timing), it is judged that the second source driver 22 has a failure. It follows that the process proceeds to Step S25.

In accordance with the judgment made by the source output judging section 74 (the failure in the second source driver 22), the control section 70 maintains the source start pulse SPOI (Sub) at the Lo level. Further, the control section 70 switches the source error flag (Sub) from the Lo level to the Hi level (Step S25). This causes the second source driver 22 to stop operating, in addition to the first source driver 21 whose operation has been already stopped. Then, it is informed outside that each of the first source driver 21 and the second source driver 22 has a failure.

The liquid crystal display device 2 of the present embodiment thus includes, in addition to an arrangement of a general liquid crystal display device: the redundant circuit (second source driver 22); the source output judging section 74; and the control section 70 for controlling these. With the arrangement, in a case where the first source driver 21 has a failure, the first source driver 21 is automatically switched over to the second source driver 22. Therefore, the liquid crystal display device 2 of the present embodiment can operate without suspending its display function in a case where the first source driver 21 has a failure. It is thus possible to (i) omit a step of switching over the source driver to the redundant circuit while the liquid crystal display device is being manufactured and (ii) extend a lifetime of the liquid crystal display device, during which the liquid crystal display device can be used by the user.

<Switchover of Gate Driver>

The following description deals with an arrangement of the gate output judging section 75 and an example of how to switch over the gate driver to another gate driver. The liquid crystal display device 2 includes the first gate driver 31 and the second gate driver 32, which first gate driver 31 is constituted by the first gate chip driver 31*a* and the second gate chip driver 31*b* which are cascade-connected to each other (see FIG. 8). A gate start pulse GSPOI (Main) is supplied from the control section 70 to the first gate chip driver 31*a* so as to start driving the first gate chip driver 31*a*. The first gate chip driver 31*a* supplies the gate signal GSPIO to the next first gate chip driver 31*b* so as to start driving the first gate chip driver 31*b*. The first gate chip driver 31*b* supplies the gate signal GSPIO (Main) to the gate output judging section 75 of the control section 70. Note that the second gate driver 32 is constituted by the second gate chip driver 32*a* and the second gate chip driver 32*b* which are cascade-connected to each other, and has the same function as that of the first gate driver 31.

Figure 15:
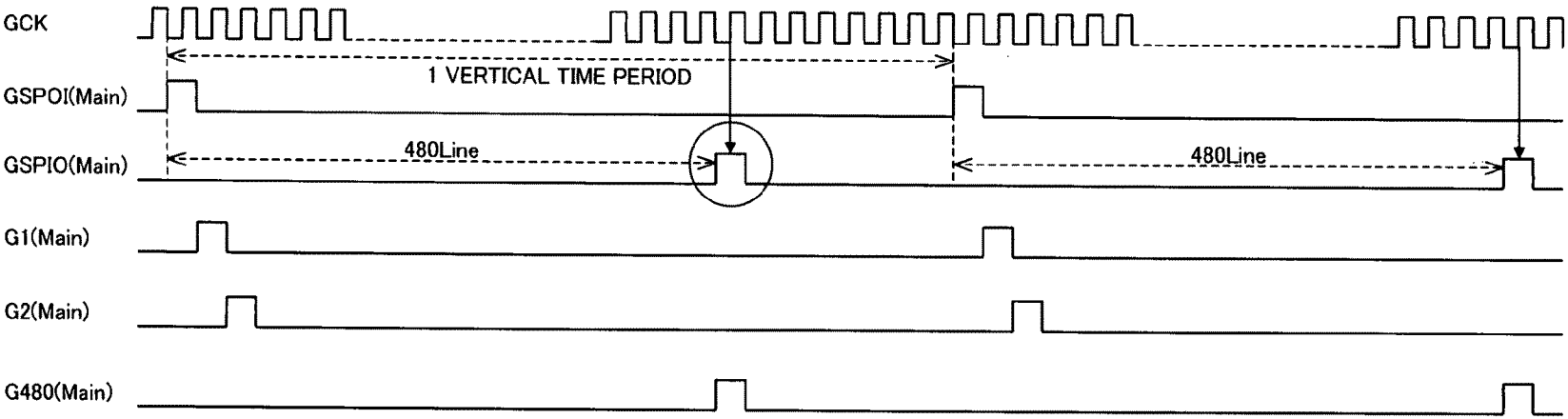
FIG. 15 is a timing chart showing various signals used by the control section and the first gate driver of the liquid crystal display device illustrated in FIG. 8 while the first gate driver operates without any problem.

The following description deals with a case where the first (main) gate driver 31 normally operates, with reference to FIGS. 8 and 15. FIG. 15 is a timing chart showing various signals in the control section 70 and the first gate driver 31 while the first gate driver 31 normally operates.

The control section 70, first, supplies the gate start pulse GSPOI (Main) which is at the output state to the first gate chip driver 31*a* and supplies a gate start pulse GSPOI (Sub), which is at the Lo level, to the second gate chip driver 32*a*. This causes (i) the first gate driver 31 to be in the active state and (ii) the second gate driver 32 to be in the non-active state. Upon the reception of GSPOI (Main) from the control section 70, the first gate chip driver 31*a* starts scanning in sync with a clock signal GCK. Note that the clock signal GCK is determined in accordance with a resolution of the display panel. Since the liquid crystal display device 2 of FIG. 8 has a resolution of 800RGB×480 (WVGA), the gate driver carries out the scanning with respect to 480 lines (480 horizontal scanning time periods).

The first gate chip drivers 31*a* and 31*b* are sequentially driven in response to the gate start pulse GSPOI (Main), and the gate signal GSPIO (Main) is supplied from the first gate chip driver 31*b* to the control section 70.

Here, the gate output judging section 75 of the control section 70 judges whether or not the gate signal is outputted at the normal timing. Specifically, the gate output judging section 75 monitors the gate signal GSPIO (Main) by use of the detection pulse as a trigger so as to judge (i) whether or not the gate signal GSPIO (Main) is outputted at timing when the time corresponding to 480 lines has elapsed since the gate start pulse GSPOI (Main) was outputted, and (ii) whether or not the gate signal GSPIO (Main) is outputted at timing other than the timing when the time corresponding to 480 lines has elapsed since the gate start pulse GSPOI (Main) was outputted. In a case where the gate output judging section 75 judges that the gate signal GSPIO (Main) is not outputted at the normal timing, it is judged that the first gate driver 31 has a failure. It follows that the control section 70 maintains the gate start pulse GSPOI (Main) to be at the Lo level (later described with reference to FIG. 16).

The gate signal GSPIO (Main) is outputted at the normal timing in the case of FIG. 15 (see a circled part of FIG. 15). Therefore, it is judged that the first gate driver 31 is normal, and the gate error flag (Main) is maintained at the Lo level.

Accordingly, the gate start pulse GSPOI (Main) is supplied again from the control section 70 to the first gate chip driver 31*a* in the next frame, and the process described above is repeated. That is, since the first gate driver 31 has no failure in the case shown by FIG. 15, the process is repeated by the first gate driver 31 without the switchover from the first gate driver 31 to the second gate driver 32. Here, each of the signals inputted into/outputted from the second gate driver 32 is maintained at the Lo level. Note that the gate error flag (Main) and the gate error flag (Sub), which are supplied to the informing section 80, are at the Lo level. Therefore, for example, both of the LED lamp (Main) for the first gate driver 31 and the LED lamp (Sub) for the second gate driver 32 emit "green light", which indicates the normal state.

Figure 16:
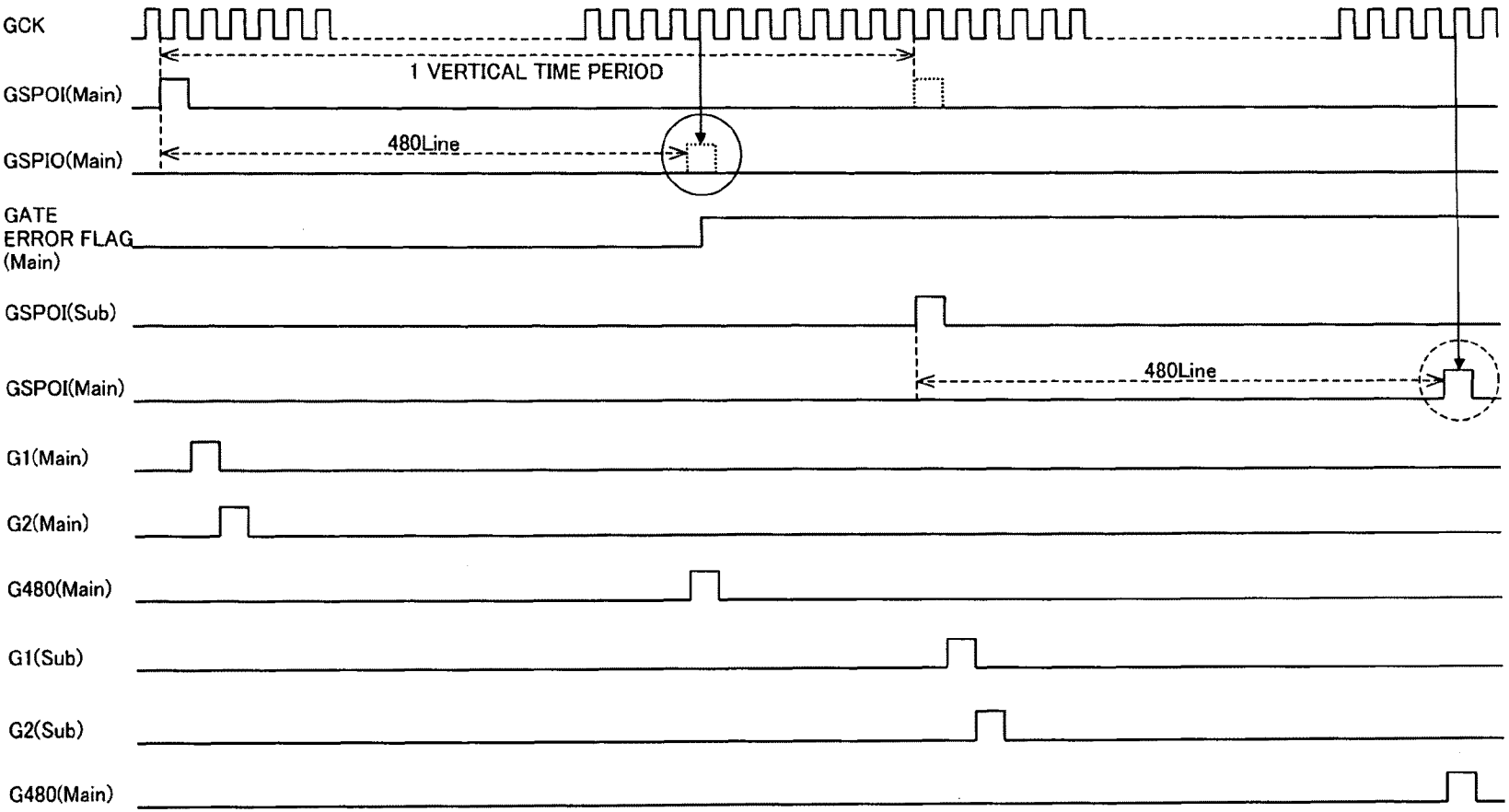
FIG. 16 is a timing chart showing various signals used by the control section and the first gate driver of the liquid crystal display device illustrated in FIG. 8 in a case where the first gate deriver has a failure.

Next, the following description deals with a case where the first (main) gate driver 31 has a failure, with reference to FIGS. 8 and 16. FIG. 16 is a timing chart showing various signals in the control section 70 and the first gate driver 31 in a case where the first gate driver has a failure. Here, the first gate chip driver 31*a* has a failure, and the gate signal GSPIO is therefore not supplied to the first chip gate driver 31*b*. It follows that the gate signal GSPIO (Main) is not outputted from the first source chip driver 31*b* at the normal timing (see a circled part of FIG. 16). In this case, the gate signal GSPIO (Main) is not supplied to the gate output judging section 75 at the normal timing (timing when the time corresponding to 480 gate lines has elapsed since the gate start pulse GSPOI (Main) was outputted). Therefore, the gate output judging section 75 judges that the first gate driver 31 has a failure. Then, the control section 70 (i) maintains the gate start pulse GSPOI (Main) at the Lo level and (ii) switches the gate error flag (Main) from the Lo level to the Hi level. This switches the first gate driver 31 from the active state to the non-active state. Then, the first gate driver 31 stops operating. Simultaneously, the informing section 80 informs outside a message indicating that the first gate driver 31 has a failure. For example, the LED lamp (Main) for the first gate driver 31 emits "red light" which indicates the abnormal state, instead of "green light" which indicates the normal state. This allows the user to recognize that the first gate driver 31 has a failure.

After that, the control section 70 switches the gate start pulse GSPOI (Sub) from the Lo level to the output state by causing the gate start pulse GSPOI (Sub) to be in synchronization with start timing of the next frame. This switches the second gate driver 32 from the non-active state to the active state. It follows that the second gate chip drivers 32*a* and 32*b* of the second gate driver 32 are sequentially driven, and the gate signal GSPIO (Sub) is supplied from the second gate chip driver 32*b* to the control section 70.

The gate output judging section 75 of the control section 70 monitors the gate signal GSPIO (Sub) by use of the detection pulse as a trigger so as to judge (i) whether or not the gate signal GSPIO (Sub) is outputted at timing when the time corresponding to 480 lines has elapsed since the gate start pulse GSPOI (Sub) was outputted and (ii) whether or not the gate signal GSPIO (Sub) is outputted at timing other than the timing when the time corresponding to 480 lines has elapsed since the gate start pulse GSPOI (Sub) was outputted. Since the gate signal GSPIO (Sub) is outputted at the normal timing in the case shown by FIG. 16, it is judged that the second gate driver 32 is normal. It follows that the gate error flag (Sub) is maintained at the Lo level.

Accordingly, the gate start pulse GSPOI (Sub) is supplied again from the control section 70 to the second gate driver 32 in the next frame, and the process described above is repeated. That is, since the second gate driver 32 has no failure in the case shown by FIG. 16, the process is repeated by the second gate driver 32. Here, each of the signals inputted into/outputted from the first gate driver 31, which has been judged as having a failure, is maintained at the Lo level.

In a case where the gate output judging section 75 judges that the gate signal GSPIO (Sub) is not outputted at the normal timing, it is judged that the second gate driver 32 has a failure. It follows that the control section 70 maintains the gate start pulse GSPOI (Sub) at the Lo level. This switches the second gate driver 32 from the active state to the non-active state. Then, the second gate driver 32 stops operating. Further, the control section 70 switches the gate error flag (Sub) from the Lo level to the Hi level so that the informing section 80 informs outside a message indicating that the second gate driver 32 has a failure. For example, the LED lamp (Sub) for the second gate driver 32 emits "red light" which indicates the abnormal state, instead of "green light" which indicates the normal state. As a result, both the LED lamp (Main) and the LED lamp (Sub) emit "red light". This allows the user to recognize that each of the first gate driver 31 and the second gate driver 32 has a failure.

Figure 17:
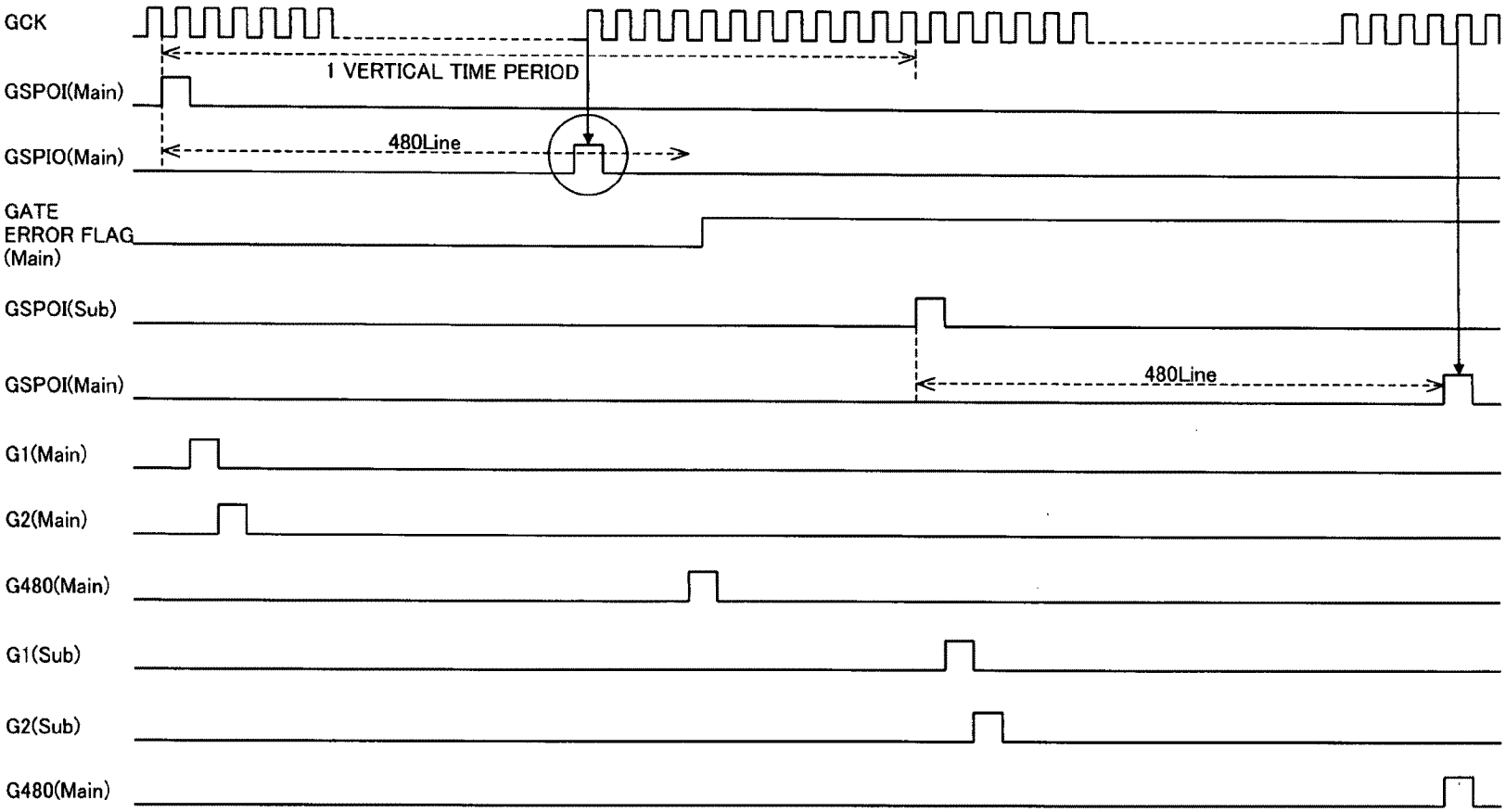
FIG. 17 is a timing chart showing another example in the case where the first gate driver illustrated in FIG. 16 has a failure.

FIG. 16 shows the case where the gate signal GSPIO (Main) is not outputted due to a failure in the first gate chip driver 31*a*. Note, however, that examples of such a failure encompass (i) a case where the gate signal GSPIO (Main) is outputted at improper timing as shown in FIG. 17 and (ii) a case where the gate signal GSPIO (Main) is outputted both at the normal timing and at the improper timing. In this regard, the gate output judging section 75 of the liquid crystal display device 2 of the present embodiment can successfully detect a failure in the gate driver, because it judges (i) whether or not the gate signal GSPIO (Main) is outputted at timing when the time corresponding to 480 lines has elapsed since the gate start pulse GSPOI (Main) was outputted and (ii) whether or not the gate start pulse GSPIO (Main) is outputted at timing other than the timing when the time corresponding to 480 lines has elapsed since the gate start pulse GSPOI (Main) was outputted.

Further, the following arrangements are applicable to the arrangement of the gate drivers, as they are applicable to Embodiment 1 and the arrangement of the source drivers: (i) the arrangement in which the cycle of the detection pulse is shortened for improvement in detection accuracy, and (ii) the arrangement in which the judgment of the failure in the gate driver is carried out on the basis of the number of times of consecutive judgments that the gate signal is not outputted normally.

According to the present embodiment, the gate signal GSPIO which (i) is supplied (returned) from the gate driver to the gate output judging section 75 and (ii) is subjected to the detection of failure is the last start pulse output GSPIO (Main). Note, however, that the present embodiment is not limited to this, and the gate signal GSPIO can be supplied from the first gate chip driver 31*a* to the gate output judging section 75, for example. Alternatively, it is possible to arrange such that (i) the gate signal GSPIO is supplied from the first gate chip driver 31*a* to the gate output judging section 75, and (ii) the gate output judging section 75 judges whether or not the gate signal GSPIO thus received is outputted improperly.

Figure 18:
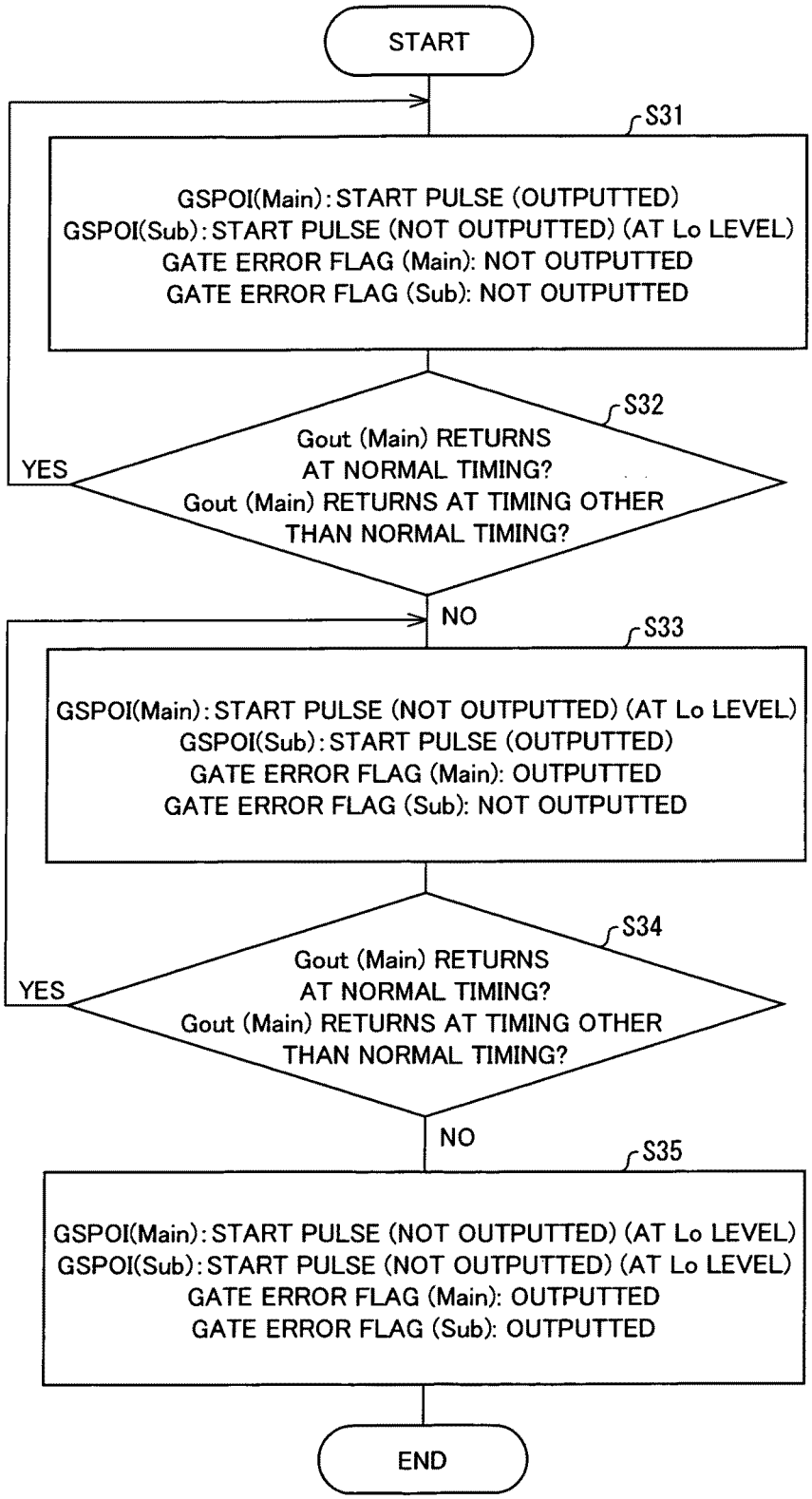
FIG. 18 is a flowchart showing an example of how the liquid crystal display device (gate driver) illustrated in FIG. 8 operates.

FIG. 18 is a flowchart showing an example of the foregoing operation. The control section 70 causes the gate start pulse GSPOI (Main) to be the output state (Step S31) (see FIG. 18). Here, the gate start pulse GSPOI (Sub), the gate error flag (Main), and the gate error flag (Sub) are at the Lo level.

Next, the gate output judging section 75 judges (i) whether or not the gate signal GSPIO (Main) is outputted at the normal timing and (ii) whether or not the gate signal GSPIO (Main) is outputted at timing other than the normal timing (Step S32).

In a case of YES in Step S32 (i.e. in a case where the gate signal GSPIO (Main) is outputted at the normal timing and is not outputted at timing other than the normal timing), it is judged that the first gate driver 31 is normal. It follows that the process is returned to Step S31, and the normal operation is repeated by the first gate driver 31.

In contrast, in a case of NO in Step S32 (i.e. in a case where (i) the gate signal GSPIO (Main) is not outputted at the normal timing, (ii) the gate signal GSPIO (Main) is outputted at timing other than the normal timing, or (iii) the gate signal GSPIO (Main) is outputted both at the normal timing and at timing other than the normal timing), it is judged that the first gate driver 31 has a failure. It follows that the process proceeds to Step S33.

In accordance with the judgment made by the gate output judging section 75 (the failure in the first gate driver 31), the control section 70 maintains the gate start pulse GSPOI (Main) at the Lo level and switches the gate start pulse GSPOI (Sub) to the output state. Further, the control section 70 switches the gate error flag (Main) from the Lo level to the Hi level (Step S33). Note that the gate error flag (Sub) is maintained at the Lo level. This causes (i) the first gate driver 31 to stop operating, and (ii) the second gate driver 32 to start operating. Simultaneously, it is informed outside that the first gate driver 31 has a failure.

Next, the gate output judging section 75 monitors the output timing of the gate signal GSPIO (Sub) so as to judge how the second gate driver 32 operates, in a manner similar to Step S32 (Step S34).

In a case of YES in Step S34 (i.e. in a case where the gate signal GSPIO (Sub) is outputted at the normal timing and is not outputted at timing other than the normal timing), it is judged that the second gate driver 32 is normal. It follows that the process is returned to Step S33, and the normal operation is repeated by the second gate driver 32.

In contrast, in a case of NO in Step S34 (i.e. in a case where (i) the gate signal GSPIO (Sub) is not outputted at the normal timing, (ii) the gate signal GSPIO (Sub) is outputted at timing other than the normal timing, or (iii) the gate signal GSPIO (Sub) is outputted both at the normal timing and timing other than the normal timing), it is judged that the second gate driver 32 has a failure. It follows that the process proceeds to Step S35.

In accordance with the judgment made by the gate output judging section 75 (the failure in the second gate driver 32), the control section 70 maintains the gate start pulse GSPOI (Sub) at the Lo level. Further, the control section 70 switches the gate error flag (Sub) from the Lo level to the Hi level (Step S35). This causes the second gate driver 32 to stop operating, in addition to the first gate driver 31 whose operation has been already stopped. Then, it is informed outside that each of the first gate driver 31 and the second gate driver 32 has a failure.

The liquid crystal display device 2 of the present embodiment thus includes, in addition to an arrangement of a general liquid crystal display device: the redundant circuit (second gate driver 32); the gate output judging section 75; and the control section 70 for controlling these. With this arrangement, in a case where the first gate driver 31 has a failure, the first gate driver 31 is automatically switched over to the second gate driver 32. Accordingly, the liquid crystal display device 2 of the present embodiment can operate without suspending its display function, in a case where the first gate driver 31 has a failure. It is thus possible to (i) omit a step of switching over the gate driver to the redundant circuit while the liquid crystal display device is being manufactured, and (ii) extend a lifetime of the liquid crystal display device, during which the liquid crystal display device can be used by the user.

The control section 70 of the present embodiment 2 includes both the source output judging section 74 and the gate output judging section 75. Therefore, it is also possible to arrange the control section 70 to control the first source driver 21, the second source driver 22, the first gate driver 31, and the second gate driver 32, on the basis of the judgments made by the source output judging section 74 and the gate output judging section 75. For example, it is possible to arrange the control section 70 to control both of the first gate driver 31 and the second gate driver 32 to stop operating when it is judged that both of the first source driver 21 and the second source driver 22 have their respective failures. This can be realized, for example, by causing the control section 70 to control the gate start pulse GSPOI (Main) and the gate start pulse GSPOI (Sub) to be maintained at the Lo level when the source error flag (Sub) (Hi level) of the second source driver 22 is outputted. Note that it is also possible to arrange the control section 70 to control the first source driver 21 and the second source driver 22 to stop operating, on the basis of a failure in the first gate driver 31 and a failure in the second gate driver 32.

Figure 19:
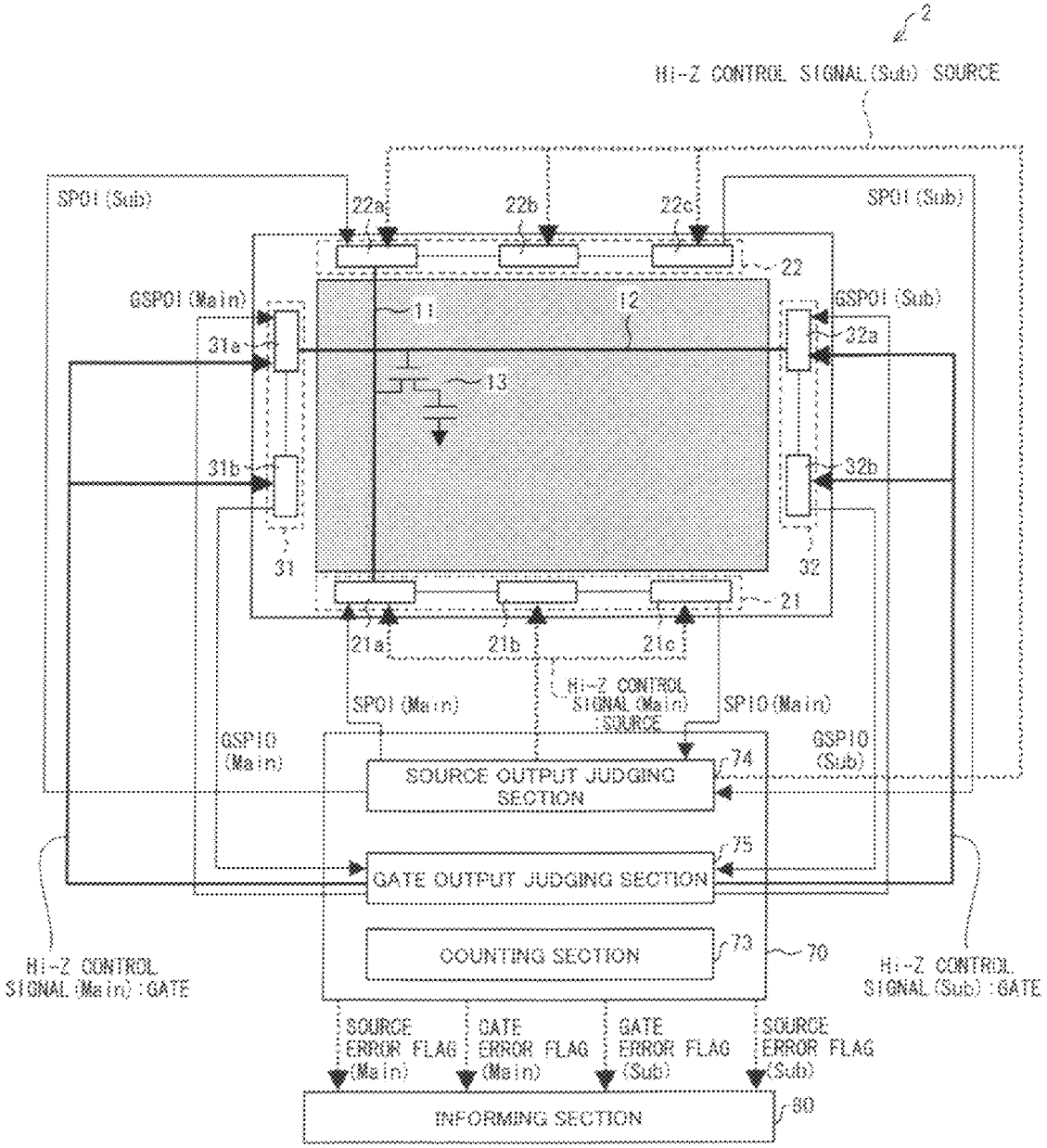
FIG. 19 is a block diagram illustrating another arrangement of the liquid crystal display device illustrated in FIG. 8.
Figure 20:
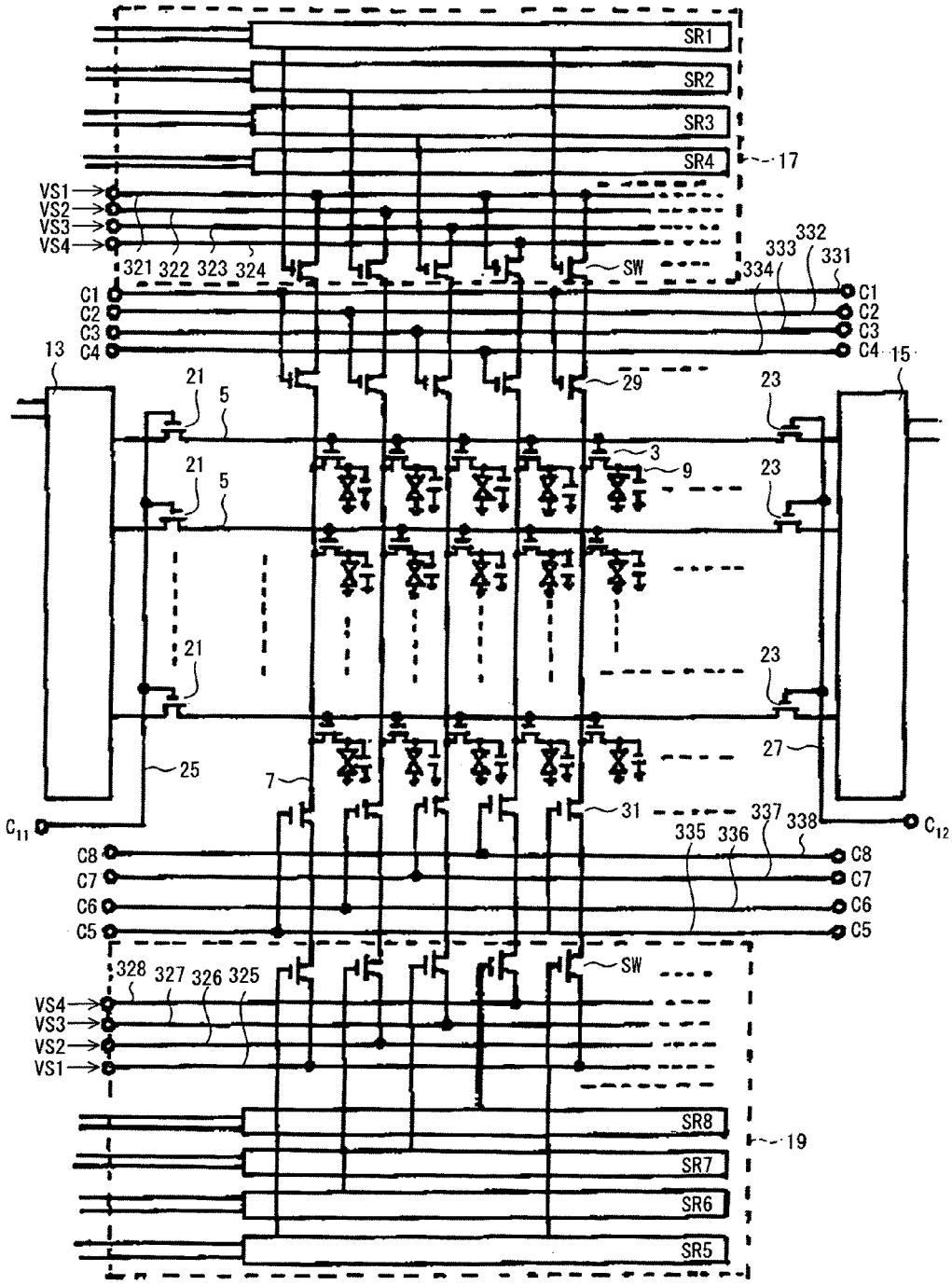
FIG. 20 is a block diagram illustrating an arrangement of a conventional liquid crystal display device.

Further, the control section 70 can be arranged so as to supply control signals (Hi-Z control signal) to the chip drivers (see FIG. 19). Specifically, the control section 70 initially supplies (i) a source control signal (Main) which is at the Hi level to each of the first source chip drivers 21*a*, 21*b*, and 21*c*, (ii) a source control signal (Sub) which is at the Lo level to each of the second source chip drivers 22*a*, 22*b*, and 22*c*, (iii) a gate control signal (Main) which is at the Hi level to each of the first gate chip drivers 31*a* and 31*b*, and (iv) a gate control signal (Sub) which is at the Lo level to each of the second gate chip drivers 32*a* and 32*b*. Here, in a case where a Main source (gate) chip driver has a failure, the switchover to its redundant circuit is carried out by switching (i) the source (gate) control signal (Main) to the Lo level and (ii) the source (gate) control signal (Sub) to the Hi level.

The control signal is supplied to each chip driver in the arrangement illustrated in FIG. 19. For this reason, it is possible to switch each failed chip driver to a corresponding normal redundant chip driver. For example, in a case where the first source chip driver 21*b* has a failure, (i) the source control signals (Main) to be supplied to the first source chip drivers 21*a* and 21*c* are maintained at the Hi level while the source control signal (Main) to be supplied to the first source chip driver 21*b* is switched from the Hi level to the Lo level and (ii) the source control signals (Sub) to be supplied to the second source chip drivers 22*a* and 22*c* are maintained at the Lo level while the source control signal (Sub) to be supplied to the second source chip driver 22*b* is switched from the Lo level to the Hi level. Such an arrangement also applicable to the arrangement of the gate chip drivers. It becomes thus possible to switch over only a chip driver having a failure to a corresponding redundant chip driver having no failure. This (i) improves the reliability of the liquid crystal display device and (ii) further extends a lifetime of the liquid crystal display device.

The present invention is not limited to the description of the embodiments, but can be altered by a skilled person in the art within the scope of the claims. An embodiment based on a proper combination of technical means disclosed in different embodiments is encompassed in the technical scope of the present invention.

INDUSTRIAL APPLICABILITY

The present invention is suitably applicable to, in particular, the driving of an active matrix liquid crystal display device.

REFERENCE SIGNS LIST

1, 2: Liquid crystal display device (display device)
10: Liquid crystal display panel (display panel)
11: Source bus line (data signal line)
12: Gate line (scan signal line)
12*a*: Dummy line (dummy scan signal line)
13: TFT (transistor)
14: Pixel electrode
20: Source driver (data signal line driving circuit)
30: First gate driver (scan signal line driving circuit)
40: Second gate driver (scan signal line driving circuit)
50: First switching section (switching means)
51: First switch (switching element)
60: Second switching section (switching means)
61: Second switch (switching element)
70: Control section (switching means)
71: Gate output judging section (judging means)
73: Counting section (counting means)
74: Source output judging section (judging means)
75: Gate output judging section (judging means)
80: Informing section (informing means)
21: First source driver (data signal line driving circuit)
21*a*: First source chip driver
21*b*: First source chip driver
21*c*: First source chip driver
22: Second source driver (data signal line driving circuit)
22*a*: Second source chip driver
22*b*: Second source chip driver
31: First gate driver (scan signal line driving circuit)
31*a*: First gate chip driver
31*b*: First gate chip driver
32: Second gate driver (scan signal line driving circuit)
32*a*: Second gate chip driver
32*b*: Second gate chip driver
30*a*: Shift register

The invention claimed is:

1. A display device comprising:

a display panel including a plurality of scan signal lines, a plurality of data signal lines, a plurality of pixel electrodes, and a plurality of transistors each of which (i) is connected to a corresponding one of the plurality of scan signal lines, a corresponding one of the plurality of data signal lines and a corresponding one of the plurality of pixel electrodes and (ii) is turned on/off by a scan signal supplied via the corresponding one of the plurality of scan signal lines;

a plurality of signal line driving circuits including at least one of (1) a plurality of first signal line driving circuits, which share scan signal lines to which they are connected and (2) a plurality of second signal line driving circuits, which share data signal lines to which they are connected;

judging means for judging, whether or not at least one of the plurality of signal line driving circuits has a failure, on the basis of timing at which its output signal is outputted from a corresponding one of the plurality of signal line driving circuits;

switching means for switching over to another one of the plurality of signal line driving circuits, having no failure, in a case where the judging means judges that at least one of the plurality of signal line driving circuits has a failure; and counting means for counting number of times by which the judging means determines that timing, at which an output signal is outputted from a signal line driving circuit, is not normal, wherein the judging means determines that a signal line driving circuit has a failure in a case where counting of counted by the counting means for the signal line driving circuit reaches a predetermined number of times.

2. The display device as set forth in claim 1, wherein:

the judging means judges (i) whether or not each output signal is outputted from a corresponding one of the plurality of signal line driving circuits at predetermined timing and (ii) whether or not each output signal is outputted from a corresponding one of the plurality of signal line driving circuits at timing other than the predetermined timing, the judging means determining that a signal line driving circuit has no failure, in a case where it determines that an output signal is outputted from a corresponding one of the signal line driving circuits at the predetermined timing but not at timing other than the predetermined timing, whereas determining that a signal line driving circuit has a failure, in a case where (i) it determines that an output signal is not outputted at the predetermined timing from a corresponding one of the signal line driving circuits, (ii) it determines that the output signal is outputted at timing other than the predetermined timing, or (iii) it determines that the output signal is outputted at the predetermined timing and at timing other than the predetermined timing.

3. The display device as set forth in claim 2, wherein:

the predetermined timing is timing when 1 vertical scanning time period expires; and the judging means judges (i) whether or not each of the output signals is outputted from a corresponding one of the plurality of signal line driving circuits at the timing when 1 vertical scanning time period expires and (ii) whether or not each of the output signals is outputted from a corresponding one of the signal line driving circuits at timing other than the timing when 1 vertical scanning time period expires.

4. The display device as set forth in claim 2, wherein:

the predetermined timing is timing when 1 horizontal scanning time period expires; and the judging means judges (i) whether or not each of the output signals is outputted from a corresponding one of the plurality of signal line driving circuit at the timing when 1 horizontal scanning time period expires and (ii) whether or not each of the output signals is outputted from a corresponding one of the plurality of signal line driving circuits at timing other than the timing when 1 horizontal scanning time period expires.

5. The display device as set forth in claim 2, wherein:

the plurality of first signal line driving circuits are scan signal line driving circuits;

a dummy scan signal line, which does not contribute to display, is provided most downstream in a scanning direction; and the judging means judges (i) whether or not a scan signal is supplied to the dummy scan signal line at timing when 1 horizontal scanning time period of an endmost one of the plurality of scan signal lines in the scanning direction expires and (ii) whether or not the scan signal is supplied to the dummy scan signal line at timing other than the timing when the 1 horizontal scanning period of the endmost one of the plurality of scan signal lines expires.

6. The display device as set forth in claim 1, wherein:

the plurality of first signal line driving circuits are scan signal line driving circuits each of which is connected to the plurality of scan signal lines via a respective plurality of switching elements; and the switching means switches over a scan signal line driving circuit which is determined to have a failure by the judging means to the other of the plurality of scan signal line driving circuits, having no failure, by (i) supplying an OFF signal to switching elements connected to the scan signal line driving circuit which is determined to have a failure and (ii) supplying an ON signal to switching elements connected to the other of the plurality of scan signal line driving circuits, having no failure.

7. The display device as set forth in claim 6, wherein:

the switching means further (i) stops supplying a gate start pulse to the scan signal line driving circuit which is determined to have a failure and (ii) supplies the gate start pulse to the other of the plurality of scan signal line driving circuits, having no failure.

8. The display device as set forth in claim 1, wherein:

the plurality of second signal line driving circuits are data signal line driving circuits; and the judging means judges whether or not a data signal line driving circuit has a failure, on the basis of timing at which a data signal is outputted from the data signal line driving circuit.

9. The display device as set forth in claim 8, wherein:

the judging means (i) stops supplying a source start pulse to the data signal line driving circuit which is determined to have a failure and (ii) starts supplying the source start pulse to the other of the plurality of data signal line driving circuits, having no failure.

10. The display device as set forth in claim 1, further comprising:

informing means for informing outside how the plurality of signal line driving circuits operate, the informing means informing outside, in accordance with a result judged by the judging means, whether or not each of the plurality of signal line driving circuits has a failure.

11. A display device comprising:

a display panel including a plurality of scan signal lines, a plurality of data signal lines, a plurality of pixel electrodes, and a plurality of transistors each of which (i) is connected to a corresponding one of the plurality of scan signal lines, a corresponding one of the plurality of data signal lines and a corresponding one of the plurality of pixel electrodes and (ii) is turned on/off by a scan signal supplied via the corresponding one of the plurality of scan signal lines;

a plurality of signal line driving circuits including at least one of (1) a plurality of first signal line driving circuits, which share scan signal lines to which they are connected and (2) a plurality of second signal line driving circuits, which share data signal lines to which they are connected;

judging means for judging, whether or not at least one of the plurality of signal line driving circuits has a failure, on the basis of timing at which its output signal is outputted from a corresponding one of the plurality of signal line driving circuits; and switching means for switching over to another one of the plurality of signal line driving circuits, having no failure, in a case where the judging means judges that at least one of the plurality of signal line driving circuits has a failure, wherein the judging means judges (i) whether or not each output signal is outputted from a corresponding one of the plurality of signal line driving circuits at predetermined timing and (ii) whether or not each output signal is outputted from a corresponding one of the plurality of signal line driving circuits at timing other than the predetermined timing;

the judging means determines that a signal line driving circuit has no failure, in a case where the judging means determines that an output signal is outputted from a corresponding one of the signal line driving circuits at the predetermined timing but not at timing other than the predetermined timing;

the judging means determines that a signal line driving circuit has a failure, in a case where the judging means determines that (i) an output signal is not outputted at the predetermined timing from a corresponding one of the signal line driving circuits, (ii) the output signal is outputted at timing other than the predetermined timing, or (iii) the output signal is outputted at the predetermined timing and at timing other than the predetermined timing;

the plurality of first signal line driving circuits are scan signal line driving circuits;

a dummy scan signal line, which does not contribute to display, is provided most downstream in a scanning direction; and the judging means judges, (i) whether or not a scan signal is supplied to the dummy scan signal line at timing when one horizontal scanning time period of an endmost one of the plurality of scan signal lines in the scanning direction expires, and (ii) whether or not the scan signal is supplied to the dummy scan signal line at timing other than the timing when the one horizontal scanning period of the endmost one of the plurality of scan signal lines expires.

12. The display device as set forth in claim 11, wherein:

the plurality of first signal line driving circuits are scan signal line driving circuits each of which is connected to the plurality of scan signal lines via a respective plurality of switching elements; and the switching means switches over a scan signal line driving circuit which is determined to have a failure by the judging means to the other of the plurality of scan signal line driving circuits, having no failure, by (i) supplying an OFF signal to switching elements connected to the scan signal line driving circuit which is determined to have a failure and (ii) supplying an ON signal to switching elements connected to the other of the plurality of scan signal line driving circuits, having no failure.

13. The display device as set forth in claim 12, wherein:

the switching means further (i) stops supplying a gate start pulse to the scan signal line driving circuit which is determined to have a failure and (ii) supplies the gate start pulse to the other of the plurality of scan signal line driving circuits, having no failure.

14. The display device as set forth in claim 11, further comprising:

informing means for informing outside how the plurality of signal line driving circuits operate, the informing means informing outside, in accordance with a result judged by the judging means, whether or not each of the plurality of signal line driving circuits has a failure.

* * * * *